US006076218A

United States Patent [19]

Taniguchi et al.

[11] Patent Number: 6,076,218

[45] Date of Patent: Jun. 20, 2000

[54] APPARATUS FOR REMOVING PRINTING MATERIAL

[75] Inventors: Kazuko Taniguchi, Takatsuki; Naoki Yoshie, Kyoto; Masazumi Yoshida, Amagasaki, all of Japan

[73] Assignee: Minolta Co., Ltd., Osaka, Japan

[21] Appl. No.: 09/057,474

[22] Filed: Apr. 9, 1998

[30] Foreign Application Priority Data

| | | | |
|---|---|---|---|
| Apr. 10, 1997 | [JP] | Japan | 9-092288 |
| Apr. 14, 1997 | [JP] | Japan | 9-095677 |
| Apr. 14, 1997 | [JP] | Japan | 9-095680 |
| Apr. 14, 1997 | [JP] | Japan | 9-095687 |
| Apr. 14, 1997 | [JP] | Japan | 9-095689 |
| Apr. 15, 1997 | [JP] | Japan | 9-097162 |
| Jun. 3, 1997 | [JP] | Japan | 9-145314 |

[51] Int. Cl.[7] ..... B08B 11/00

[52] U.S. Cl. ..... 15/102; 15/77; 399/411

[58] Field of Search ..... 15/3, 77, 97.1, 15/100, 102, 103.5; 156/247, 281, 389; 399/1, 411

[56] References Cited

U.S. PATENT DOCUMENTS

| | | | |
|---|---|---|---|
| 5,006,189 | 4/1991 | Tsukamoto et al. . | |
| 5,353,108 | 10/1994 | Tsukamoto | 156/281 |
| 5,400,123 | 3/1995 | Sato et al. | 15/77 |
| 5,474,617 | 12/1995 | Saito et al. . | |
| 5,572,311 | 11/1996 | Abe et al. | 399/411 |
| 5,607,534 | 3/1997 | Kawanishi et al. | 15/77 |
| 5,619,765 | 4/1997 | Tokita et al. | 15/3 |
| 5,642,550 | 7/1997 | Maruyama et al. | 15/102 |
| 5,652,989 | 8/1997 | Chiba et al. | 15/102 |
| 5,855,734 | 1/1999 | Saito et al. | 15/3 |

FOREIGN PATENT DOCUMENTS

| | | |
|---|---|---|
| 04064472 | 2/1992 | Japan . |
| 04116000 | 4/1992 | Japan . |
| 07020754 | 1/1995 | Japan . |
| 08190315 | 7/1996 | Japan . |

*Primary Examiner*—Terrence R. Till
*Attorney, Agent, or Firm*—McDermott, Will & Emery

[57] ABSTRACT

An apparatus according to the present invention removes printing material from a recording member on which an image is recorded by the printing material. The apparatus comprises a releasing member and heating member. The releasing member comes into pressure contact with the recording member, adheres to the printing material on the recording member, and then separates from the recording member to release the printing material from the recording member. The heating member heats at least any one of the contact surface of the recording member to the releasing member or the contact surface of the releasing member to the recording member.

27 Claims, 19 Drawing Sheets

APPARATUS FOR REMOVING PRINTING MATERIAL

This application based on applications Nos. 9-92288, 9-95677, 9-95689, 9-95687, 9-95680, 9-97162 and 9-145314 filed in Japan, the contents of which are hereby incorporated by reference.

BACKGROUND OF THE INVENTION

The present invention relates to an apparatus for removing printing material on the recording member recorded by an electro-photographic system.

Conventionally, there has been proposed, from the viewpoint of paper recycling, an apparatus for removing the printing material on the recording member recorded by an electro-photographic system. Such printing material removing apparatus includes one to dissolve or swell the printing material by organic solvent and remove it with a brush or supersonic wave, or one to remove the thermoplastic printing material by heat transfer.

Since the former apparatus is to use organic solvent, it has high possibility to provide problems in safety (in fire protection, influence on human body, etc.) and handling (odor, liquid leakage, etc.), and especially it is not desirable to be used in office.

The latter apparatus is disclosed, for example, in Japanese Laid-open Patent Publications No. 1-297294 (1989), No. 4-64472 (1992), No. 4-94958 (1992) and No. 4-116000 (1992). In such apparatuses, a heat-melting releasing member is brought into contact with the recording member and heated. Then the releasing member is cooled and separated from the releasing member, thereby the printing material on the recording member is released and transferred onto the recording member.

In those apparatuses, since the aggregation force between the printing materials (toner) on the recording member is not sufficient, the toner is broken off in the releasing part, so that the toner is not fully transferred to the releasing member but remains on the recording member.

In addition, the aggregation force between the printing materials transferred onto the heat-melting releasing member is also insufficient. Therefore, in the case that the toner removing process is repeated a plurality of times, when the toner once transferred to the heat-melting releasing member subsequently comes into contact with the recording member, a part of toner is broken off from the releasing member to retransfer to the recording member.

Moreover, in the above described apparatuses, it takes a long time to cool the releasing member and the recording member after the releasing member is brought into pressure contact with the recording member and heated. This was a barrier to speed-up of toner removing process.

In the above described apparatuses, a large force is required to separate the recording member from the releasing member, and in actual it is necessary to press the separation blade against the releasing member for a long period. Thus, the surface layer of the releasing member is likely to be peeled.

SUMMARY OF THE INVENTION

The present invention has been developed to substantially eliminate the above-described disadvantages.

It is therefore an object of the present invention to provide a printing material removing apparatus with which the printing material can be surely removed from the recording member without discontinuing the printing material in transferring the printing material from the recording member to the releasing member.

It is an another object of the present invention to provide a printing material removing apparatus in which retransfer of the printing material to the recording member from the releasing member does not occur.

It is an another object of the present invention to provide a printing material removing apparatus which shortens a time which is taken to cool the releasing member and the recording member after the releasing member is brought into pressure contact with the recording member and heated, and enables to speed-up the printing material removing process.

It is an another object of the present invention to provide a printing material removing apparatus in which peeling of the surface of the releasing member is prevented and printing material removing process is stably performed for a long period.

In order to accomplish the above object, the present inventors made strenuous study and as a result have found out the following conclusion. That is to say, when the recording member is in a condition of adhesion to the releasing member, it is a necessary condition for the printing material to be transferred from the recording member to the releasing member that F2>F3 as well as F1>F3, where F1 is an adhesive force between the releasing member surface layer and the printing material, F2 is an aggregation force of the printing material, and F3 is an adhesive force between the printing material and the recording member.

It is because, even if the condition of F1>F3 applies, if F2<F3 exists, when the releasing member and the recording member are separated, the printing material is broken off, and the toner remains on the recording member. The conditions of F1>F3 can be attained by pertinently selecting the releasing member and the recording member. However, the conditions of F2>F3 cannot easily be attained because some of the printing materials may have weak aggregation force. When the printing material recorded on the recording member is observed with a microphotograph, it is observed that the particles of the printing material are mutually fused but there exist many spaces between them. Due to the existence of such spaces, the printing material cannot be released in the whole but is partially broken off to remain on the recording member. Then, it has been known that, when heat is applied to the recording member having the printing material, the spaces between the particles of the printing material are disappeared, and consequently the whole printing materials can be released.

The present invention is made on the basis of the above finding. According to the present invention, there is provided an apparatus for removing printing material from a recording member on which an image is recorded by the printing material, comprising:

- a releasing member which comes into pressure contact with the recording member and adheres to the printing material on the recording member, and then separates from the recording member to release the printing material from the recording member; and
- heating means for heating at least any one of the contact surface of the recording member to the releasing member or the contact surface of the releasing member to the recording member.

The releasing member is preferably a material having high adhesion property to the printing material on the recording member. The possible releasing member can be of a single layer structure or a lamination structure. In the case of a single layer structure, the resin sheet of polyethylene terephthalate, polyethylene naphthalate, polycarbonate, etc. or metal sheet of nickel, aluminum, and the like may be used. Furthermore, in order to improve the adhesion property of the releasing member, there can be considered to use a releasing member of plural layer constitution made by coating a surface layer material having a higher adhesive property on the substrate layer.

In the case of the resin material, the adhesion property between the materials correlates with their inherent SP values (solubility parameters). The materials whose SP values are proximate are highly adhesive to each other. Since the acrylic resin and the polyester resin which are the main components of the printing materials have the SP values of 9 to 11, it is especially preferable to use a resin material having the SP value of 8 to 12 as the releasing material of the present invention.

As the heating means, there can be used a contact type heating roller, a non-contact type infrared ray heater, and the like. The heating temperature by this heating means may be higher than the temperature at which the released printing material on the releasing member is softened and lower than the temperature to be determined from the heat resistance of the recording member. It is preferably in the range between 80° C. and 200° C.

In the printing material removing apparatus comprising the above constitution, the printing material on the recording member is heated by the heating means prior to bringing the releasing member into pressure contact with the recording member. Whereby, the aggregation force between the printing materials on the recording member is strengthened, so that, in the course of transfer of the printing material from the recording member to the releasing member, no discontinuance of the printing material occurs, and assured transfer to the releasing member can be obtained.

In addition, in the printing material removing apparatus comprising the above constitution, the printing material on the releasing member released from the recording member is also heated by the heating means. Whereby, the aggregation force between the printing materials on the releasing member is strengthened, and adhesive force of the printing material to the releasing is increased, preventing the printing material from retransferring to the recording member.

According to another aspect of the present invention, the printing material removing apparatus may comprise a heat insulating wall surrounding a part where the recording member is separated from the releasing member. This prevents the heat generated in a part where the releasing member comes into pressure contact with the recording member and the recording member is heated from transmitting to the separation part. As a result, cooling time of the recording member to the separation part from the pressure contact part is shortened.

According to another aspect of the present invention, the releasing member may be provided with a releasing portion, wherein the recording member comes into pressure contact with the releasing member so that the releasing member coincides with the front end of the recording member. In this case, the separating member enters between the releasing portion of the releasing member and the recording member, enabling the recording member to be easily separated. Moreover, it is not necessary to strongly bring the separating member into pressure contact with the releasing member, whereby peeling of the releasing member is prevented. The releasing portion is preferably formed by removing the releasing member or by applying a releasing agent on the surface of the releasing member.

Alternatively, the apparatus may further comprises a separating member for separating the recording member from the releasing member, and wherein the releasing member may be provided with releasing portions in both side ends, and wherein the recording member may be separated from the releasing member by bringing the separating member into pressure contact with the releasing portion.

Preferably, the separating member may be movable to a pressure contact position where the separating member comes into pressure contact with the releasing member and a retreat position where the separating member retreats from the releasing member. In this case, the separating member may move to the pressure contact position when the front end of the recording member approaches the separating member, and move to the retreat position when the front end portion of the recording member is separated from the releasing member. Moreover, the releasing member may be provided with a releasing portion, wherein the releasing member comes into pressure contact with the recording member so that the releasing portion overlaps with the front end of the recording member.

Preferably, the releasing member may include a first rotatable member and a second rotatable member having a different circumferential length from the first rotatable member, wherein a part of each rotatable member may be provided with a releasing portion, whereby the front end of the first rotatable member of the releasing member comes into pressure contact with the recording member so that the front end of the recording member overlaps with the releasing portion of the first rotatable member, and then the front end of the second rotatable member of the releasing member comes into pressure contact with the recording member so that the front end of the recording member overlaps with the releasing portion of the second rotatable member. Thus, even if the releasing portion of the first releasing member comes into contact with the releasing member except the front end thereof and a non-released portion remains on the recording member, such non-released portion is removed by the second releasing member.

In this case, the apparatus may further comprise a length detecting means for detecting the length of the recording member and a transfer passage changing means. Thereby, if the length of the recording member detected by the length detecting means is shorter than the circumferential length of the first rotatable member, the recording member does not pass through the second rotatable member. Thus, in the case of short recording member, the recording member needs not to pass through the second releasing member, whereby the processing time is shortened and power consumption is depressed.

BRIEF DESCRIPTION OF THE DRAWINGS

Further objects and advantages of the present invention will become clear from the following description taken in conjunction with the preferred embodiments thereof with reference to the accompanying drawings, in which.

DETAILED DESCRIPTION OF THE PREFERRED EMBODIMENTS

<First Embodiment>

Figure 1:
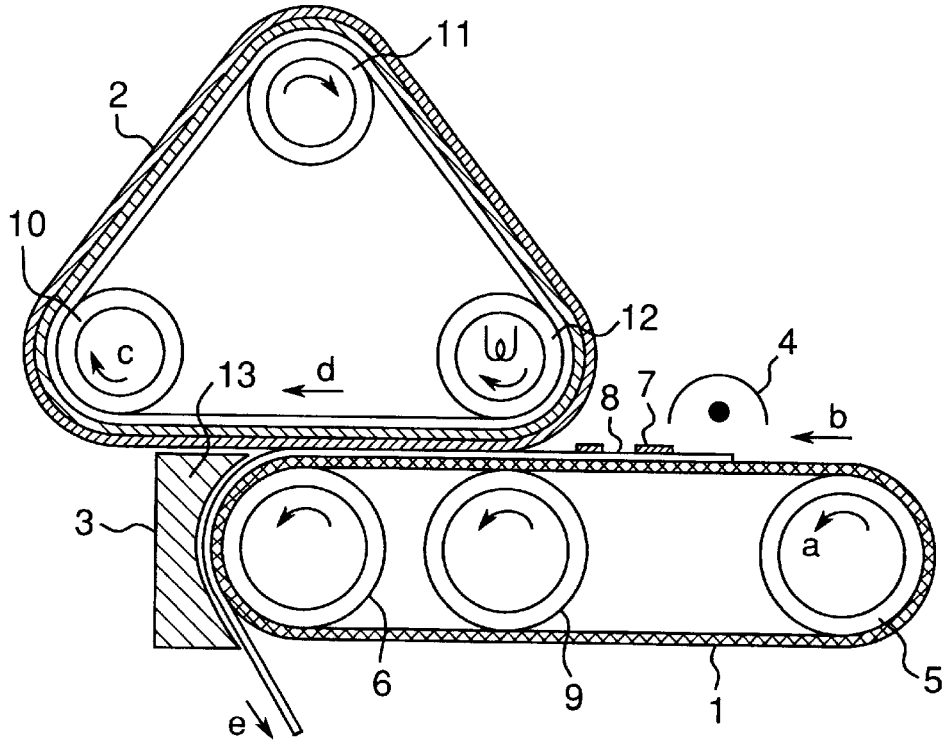
FIG. 1 is a view to show a first embodiment of the printing material removing apparatus of the present invention.

FIG. 1 shows a first embodiment of the printing material removing apparatus of the present invention. This apparatus comprises a transfer belt 1, a releasing belt 2, a separating claw 3, and a far infrared heater 4 as heating means.

The transfer belt 1 is horizontally borne between a driving roller 5 which rotates in the direction of arrow "a" and a driven roller 6. The transfer belt 1 can transfer a recording member 8, on which printing material 7 is fixed to form a picture image, horizontally in the direction of arrow "b". Between the driving roller 5 and the driven roller 6, there is disposed a backup roller 9 which rotates according to the movement of the transfer belt 1. The backup roller 9 is arranged to opposite to a heating roller 12 of the releasing belt 2 to be described later, through the transfer belt 1.

The releasing belt 2 is borne on a driving roller 10, a driven roller 11 and the heating roller 12 which are disposed in triangle relations. The releasing belt 2 is movable in the direction of arrow "d" according to the rotation of the driving roller 10 in the direction of arrow "c". The releasing belt 2 is disposed so that the driven roller 6 of the transfer belt 1 is positioned between the driving roller 10 and the heating roller 12, and the belt part between the driving roller 10 and the heating roller 12 is brought into pressure contact with the recording member 8 to be carried on the transfer belt 1. The heating roller 12 is disposed opposite to the backup roller 9 through the releasing belt 2 and the transfer belt 1. The heating roller 12 is to heat the later described releasing member surface layer 23 of the releasing belt 2 and also heat the printing material 7 of the supplied recording member 8. The heating temperature by this heating roller 12 is set at a level between 80° C. and 200° C.

The separation claw 3 has a wedge part 13 which is disposed in the portion where the belt part around the driven roller 6 of the carrying belt 1 is separated from the belt part between the driven roller 10 of the releasing belt 2 and the heating roller 12. The wedge part 13 is to separate the recording member 8 adhered to the releasing belt 2 from the releasing belt 2. The separation claw 3 and the driven roller 6 of the transfer belt 1 constitute the means for bending the recording member 8 in arc form against the releasing member surface layer 23.

The far infrared heater 4 is disposed on the upstream side in the transfer direction with respect to the point where the releasing member surface layer 23 of the releasing belt 2 is in pressure contact with the transfer belt 1. The heater 4 is to heat the printing material 7 on the recording member 8 transferred by the transfer belt 1 from above the transfer belt 1. The heating temperature by the far infrared heater 4 is set to be in the range between 80° C. and 200° C.

The recording member 8 to be treated by the printing material removing apparatus comprising the above constitution comprises a transparent plastic film (OHP sheet and the like) or a film (synthetic paper) which is made opaque by addition of inorganic fine particles. The recording member is formed with an image of the printing material 7 thereon by an appropriate image forming apparatus, as shown in FIG. 2(B). The plastic film is not specifically limited if it is a thermoplastic resin, but considering the heat resistance, the suitable ones are of polyester, polycarbonate, polyimide, polymethyl methacrylate, and the like. Of those, polyester, and especially polyethylene terephthalate is preferable in view of the universal applicability, price, heat resistance, durability, etc.

The printing material 7 which is recorded as an image in the recording member 8 is a so-called toner (hereinafter, the printing material is to be referred to as toner). The toner generally comprises acrylic (methacryl) polymer, acrylic (methacryl)-styrene copolymer, or polyester polymer as the main component, with addition of coloring agent, releasing agent, antistatic agent, etc. thereto.

Figure 2A:
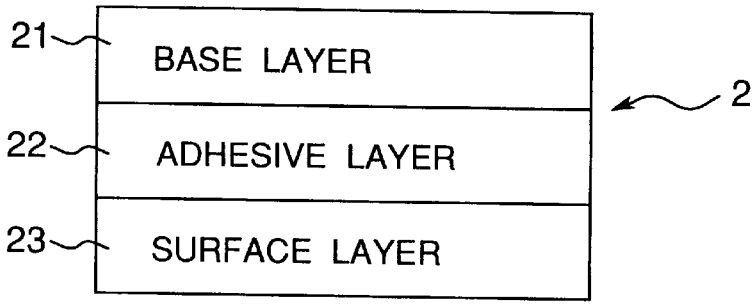
FIGS. 2A and 2B are schematic sectional views showing the constitution of the recording member and the releasing member used in the apparatus of FIG. 1.
Figure 2B:
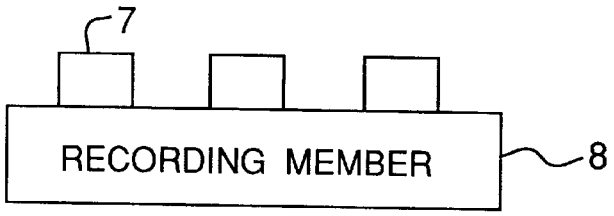

The releasing belt 2 comprises, as shown in FIG. 2A, a base layer 21, a adhesive layer 22 and a surface layer 23 provided on the base layer 21 through the adhesive layer 22.

The releasing member surface layer 23 is provided so as to release the toner 7 on the recording member 8. Namely, heat is applied to the toner 7 on the recording member 8 to soften the toner 7 and heat is also applied to the releasing member surface layer 23 to soften, then the toner 7 on the recording member 8 is caused to adhere to the releasing member surface layer 23. The lower limit of the temperature to be applied to the toner 7 is determined by the temperature at which the toner 7 is softened, and its upper limit is determined based on the heat resistance of the recording member 8. Substantially, the temperature to be applied to the toner is in the range between 80° C. and 200° C. Thus, by softening the toner 7 and also making the releasing member surface layer 23 softened state, adhesion of the toner 7 to the releasing member surface layer 23 is facilitated. For this reason, it is desirable that the releasing member surface layer 23 is thermoplastic resin having the softening point between 80° C. and 200° C. Especially, it is preferable that the softening point of the releasing member surface layer 23 is in the range of ±20° C. of the softening point of the toner. The softening point herein means the outflow starting temperature with the flow tester.

It is the essential conditions for the releasing member surface layer 23 to have good adhesive property to the toner 7. In other words, it is desirable for the material constituting the releasing member surface layer 23 to have high compatibility with the toner 7. In general, the compatibility between the different materials depends on the differences of the surface energies and SP values (solubility parameter). The materials whose SP values are close to each other show good compatibility. The SP value of the toner is variable by the kind of the resin which is the main component thereof, and it is approximately 9 to 11. The present inventors specially noted the SP value and made strenuous study of it. As a result, it has been found that when the SP value of the resin of the releasing member surface layer 23 is in the range between 8 and 12, the toner 7 on the recording member 8 is favorably transferred to the releasing member surface layer 23.

Examples of the resins having the softening points at 80–200° C., and SP value of 8–12 are polystyrene, styrene-acrylic (methacryl) copolymer, polyvinyl alcohol—vinyl acetate copolymer, polyvinyl acetal, polyester, and the like. Among these, styrene-acrylic (methacryl) copolymer, polyvinyl acetal, polyester resin, etc. are preferable from the viewpoint of the adhesion to toner, and the like.

On the other hand, the adhesive layer 22 is provided to cause the releasing member surface layer 23 to adhere to the base layer 21 and to prevent the transfer of the releasing member surface layer 23 to the recording member 8. With respect to the material to constitute the adhesive layer 22, the generally commercialized adhesives are given. Though the kinds of the adhesive are not particularly limited, there is required at least the adhesive having the heat resistance to a certain extent. Examples of the adhesive materials are vinyl/methyl ether, maleic anhydride copolymer, partially saponificated polyvinyl alcohol, vinyl acetal, ethyl acrylate, polyamide resin, phenol resin, resorcinol resin, polyester resin, epoxy resin, furan resin, polyurethane resin, chlorinated rubber, butadiene, acrylonitrile rubber, butyl rubber, neoprene rubber, Thiokol®, and the like, though not limited to them.

The method for applying the adhesive to the base layer 21 includes the chemical reaction method, heat melt method, solvent evaporation method, etc. It is preferable to take a suitable method depending on the kind of the adhesive. The surface layer 23 of the releasing member 2 is not necessarily a resin. Any material that can adhere the heated printing material may be used such as metals of Al, Ni, etc. and rubbers, without being limited to resin.

Next, the operation of the printing material removing apparatus comprising the above constitution will be described below.

When the recording member 8 on which the image is formed by the toner 7 is supplied to the transfer belt 1 under the condition of the toner 7 being positioned on the upper part, the recording member 8 is transferred in the direction of arrow "b" by the transfer belt 1. The toner 7 is heated with the far infrared heater 4 and molten. By this step, the aggregation forces between the toners 7 on the recording member 8 show increases In this manner, the recording member 8 with the toner 7 heated is inserted in the gap between the transfer belt 1 and the releasing belt 2. When the recording member 8 passes through the part between the heating roller 12 and the backup roller 9, the releasing member surface layer 23 is brought into pressure contact with the recording member 8 by the heating roller 12 to melt the toner 7 on the recording member 8. As a result, the toner 7 on the recording member 8 is fused with the releasing member surface layer 23. In this manner, the recording member 8 is further transferred in the direction of arrow "b" under the condition of the toner 7 being fused with the releasing member surface layer 23. As the recording member 8 leaves the heating roller 12, the fused toner 7 and releasing member surface layer 23 are cooled and solidified.

When the tip of the recording member 8 reaches the separation claw 3, the recording member 8 is separated from the releasing belt 2 by the separation claw 3, and discharged in the direction of arrow "e" along the periphery of the driven roller 6 of the transfer belt 1. The recording member 8 which is separated from the releasing belt 2 is bent in arc form with respect to the releasing member surface layer 23 by the separation claw 3 and the driven roller 6. As a result, a bending stress is exerted on the recording member 8, a shear force is generated between the surface of the recording member 8 and the toner 7, and the toner 7 is surely released from the recording member 8.

The toner 7 on the recording member 8 remains on the releasing member surface layer 23 in molten and solidified state by being released from the recording member 8 and transferred to the releasing member surface layer 23. Here, because, as described above, the toner 7 is heated in advance by the far infrared heater 4 to have increased aggregation force, it is securely released without showing discontinuance in the course of the release from the recording member 8 to the releasing member surface layer 23. In this manner, the toner 7 transferred to the releasing member surface layer 23 moves in the direction of arrow "d" along with the releasing belt 2, and is offered for removing the toner 7 of the recording member 8 to be subsequently supplied.

Figure 3:
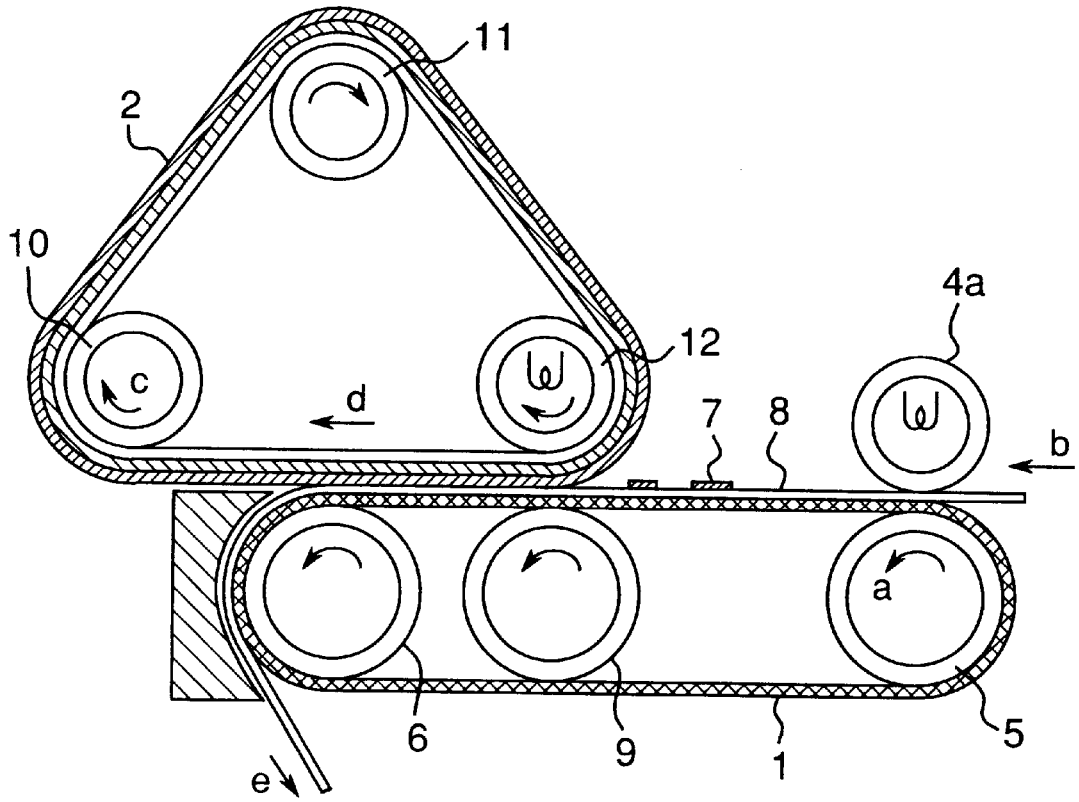
FIG. 3 is a view showing a variation of the first embodiment of the printing material removing apparatus of FIG. 1.

In the embodiment described above, the non-contact far infrared heater 4 is used as the means for heating the toner 7 on the recording member 8. However, the heating means is not limited to it, but there may be used a heating roller 4*a* for heating the toner 7 on the recording member 8 as shown in FIG. 3.

The releasing belt 2 may be provided with the means for cleaning the toner 7 fused to the releasing member surface layer 23. As the cleaning means, there may be used one which is to physically scrape off the toner 7 with a blade or one to thermally transfer to other members. By providing such cleaning means, the capacity for removing toner with the releasing member surface layer 23 can be maintained for a long period.

Furthermore, when the heating means for heating the toner 7 transferred onto the releasing member surface layer 23 is provided, the aggregation force between the transferred toners 7 becomes stronger and the adhesive force between the toner 7 and the releasing member surface layer 23 increases, so that re-transfer to the recording member 8 to be subsequently supplied is prevented. As the heating means in this case, the means similar to the far infrared heater 4 or heating rolls 12, 4*a* may be used, and their heating temperatures are also the same as those of the foregoing embodiment.

EXAMPLES

Example 1

As a releasing member 2, 100 grams of styrene-methyl methacrylate copolymer resin (SP value 9.3, softening point 110° C.) having an average molecular weight of 200000 was dissolved in 1 liter of THF to prepare a resin solution. Next, this resin solution was applied to the OHP film with a bar-coater and dried. As the OHP film, there was used one made by coating the outer surface with a methacryl-polyvinyl acetate copolymer resin (genuine OHP film made by MINOLTA Corporation). The thickness of the resin after drying was measured to be 5 μm. The both ends of this film were adhered to each other with a reactive type acrylic adhesive to prepare a seamless releasing belt 2.

As a recording member 8, there was used a polyethylene terephthalate film of 100 μm in thickness of A4 size, provided on its surface with antistatic processing with a cationic surfactant. On this recording member 8, an image of toner 7 was formed with an electrophotographic copying machine EP-4050 made by MINOLTA Corporation. As the toner 7, there was used one having a softening point at 113° C. and SP value of 9.3.

The above releasing belt 2 was set on the apparatus of FIG. 1 and moved at a speed of 0.5 cm/sec. On the other hand, the recording member 8 was transferred by the transfer belt 1 at a speed of 0.5 mm/sec. The heating temperature of the far infrared heater 4 for heating the toner 7 on the recording member 8 was kept at 150° C. The heating part (heating roller 12) and the separation part (separation claw 3) were kept at a distance of about 30 cm. At this time, the temperature of the heating roller 12 was maintained at 140° C.

When the apparatus was operated under the above conditions, in the recording member 8 which had passed the separation claw 3, the toner 7 was cleanly removed. On the other hand, there was observed the fully transferred image of the toner 7 on the releasing member surface layer 23 of the releasing belt 2.

Further, on the similar evaluations made by varying the temperatures of the heating roller 12 to various extents, the toner removal was feasible in the range of 100° C.–200° C.

Example 2

As a releasing member, there was formed a black all over image on a polyethylene terephthalate film having a thickness of 150 μm with an electrophotographic laser beam printer "FINE WRITER 401" made by MINOLTA Corporation. The process was repeated for 5 times to form a surface layer of black all over image comprising thick toner material, after which the said sleeve was stored in a high temperature bath at 150° C. to smooth the surface. And, five sheets of the film were joined at their ends with an adhesive to form a seamless releasing belt 2. The full circumference of the resulting releasing belt 2 was 100 cm.

As a recording member 8, there was used a white PET film made by dispersing the fine particles of titanium oxide therein. An image of toner 7 was formed on the recording member 8 with the above FINE WRITER 401. As the toner 7, there was used one having the softening point at 120° C. and SP value of 10.5.

The apparatus of FIG. 3 using the heating roller 4*a* as the heating means was used to operate under the same conditions as those of Example 1. When the recording member 8 discharged from the apparatus was observed, it was seen that the toner was fully removed and the recording member 8 was made re-usable.

Example 3

Evaluation of the removing performance was made under entirely same conditions as those of Example 1, except the material of the releasing member. As the releasing member, a nickel electroformed sleeve having a thickness of 40 μm was used. The toner removing performance was confirmed by varying the heating roller temperatures. It was found that the toner removal was possible in the range of 130–180° C.

Comparative Example

As the releasing member surface layer 23 and the recording member 8, the same materials as those of Example 1 were used. As the apparatus, there was used one of the Example 1 with omission of the far infrared heater 4. When the recording member 8 discharged from the apparatus was observed, there was seen a partial remaining of the toner.

As illustrated in the above examples and comparative example, according to the printing material removing apparatus of the present invention, it has been confirmed that the toner 7 can be fully released without discontinuance.

<Second Embodiment>

Embodiments described hereinafter are same as previous embodiment except especially mentioned points, and therefore same reference numerals are affixed to the same elements as that of previous embodiment. The operation of each embodiment is substantially same as that of previous embodiment except especially mentioned points.

Figure 4:
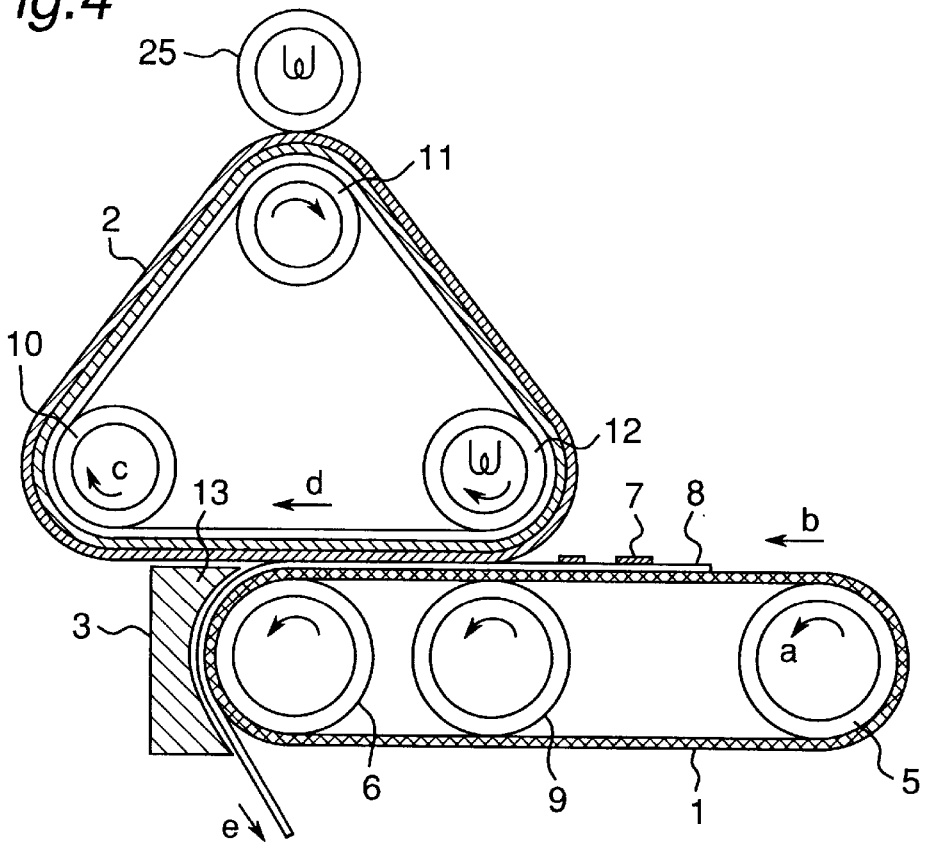
FIG. 4 is a view to show a second embodiment of the printing material removing apparatus of the present invention.

FIG. 4 shows a second embodiment of the printing material removing apparatus of the present invention.

In the second embodiment, a heating roller 25 as the heating means for heating the toner 7 transferred onto the releasing member surface layer 23 is added to the releasing roller 2. The far infrared heater 4 of FIG. 1 is not provided in the second embodiment.

The heating roller 25 is positioned so that it comes into pressure contact with the belt portion around the driven roller 10 of the releasing belt 2 to heat and melt the printing material 7 on the releasing belt 2 released from the recording member 8. The heating temperature by the heating roller 15 is set to be in the range between 80° C. and 200° C.

In operation, when the toner 7 on the releasing member surface layer 23 reaches the opposite portion to the heating roller 25, the toner 7 is heated by the heating roller 7. As a result, the aggregation force between the toners 7 becomes stronger and the adhesive force between the toner 7 and the releasing member surface layer 23 increases, so that re-transfer to the recording member 8 to be subsequently supplied is prevented.

Figure 5:
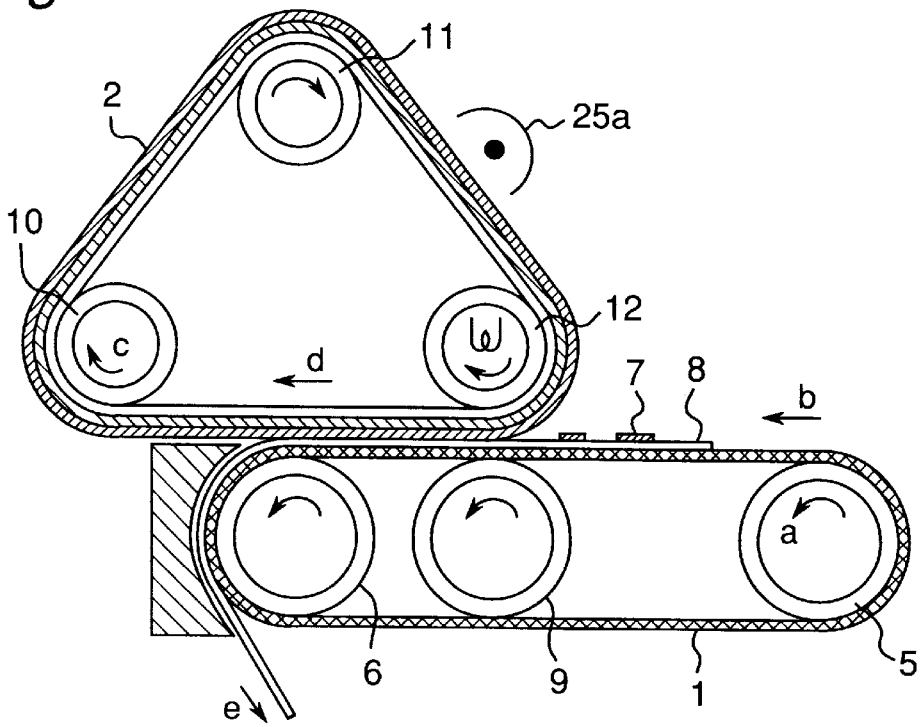
FIG. 5 is a view showing a variation of the second embodiment of the printing material removing apparatus of FIG. 4.

In the embodiment described above, the heating roller 25 is used as the means for heating the toner 7 after transfer. However, the heating means is not limited to it, but there may be used a non-contact far infrared heater 25*a* for heating the toner 7 transferred on the releasing member 2 released from the recording member 8 as shown in FIG. 5.

Furthermore, the heating means for heating the toner 7 on the recording member 8 before inserting the recording member 8 between the releasing belt 8 and the transfer belt 1 may be provided in the same manner as the first embodiment of FIG. 1 or 3 in order to increase the aggregation force of the toners 7. In this case, the toner 7 is hardly broken off and the printing material can be surely removed from the recording member. As the heating means in this case, the means similar to the far infrared heater 4 or heating roller 4*a* of the first embodiment of FIG. 1 or 3 may be used, and their heating temperatures are also the same as the first embodiment.

<Examples>

Example 4

As a releasing member 2, 100 grams of styrene-methyl methacrylate copolymer resin (SP value 9.3, softening point 110° C.) having an average molecular weight of 200000 was dissolved in 1 liter of THF to prepare a resin solution. Next, this resin solution was applied to the OHP film with a bar-coater and dried. As the OHP film, there was used one made by coating the outer surface with a methacryl-polyvinyl acetate copolymer resin (genuine OHP film made by MINOLTA Corporation). The thickness of the resin after drying was measured to be 5 μm. The both ends of this film were adhered to each other with a reactive type acrylic adhesive to prepare a seamless releasing belt 2.

As a recording member 8, there was used a polyethylene terephthalate film of 100 μm in thickness of A4 size, provided on its surface with antistatic processing with a cationic surfactant. On this recording member 8, an image of toner 7 was formed with an electrophotographic copying machine EP-4050 made by MINOLTA Corporation. As the toner 7, there was used one having a softening point at 113° C. and SP value of 9.3.

The above releasing belt 2 was set on the apparatus of FIG. 4 and moved at a speed of 0.5 cm/sec. On the other hand, the recording member 8 was transferred by the transfer belt 1 at a speed of 0.5 mm/sec. The heating roller 25 of the releasing belt 2 was kept at a temperature of 150° C. The heating part (heating roller 12) and the separation part (separation claw 3) were kept at a distance of about 30 cm. At this time, the temperature of the heating roller 12 was maintained at 150° C.

When the apparatus was operated under the above conditions, in the recording member 8 which had passed the separation claw 3, the toner 7 was cleanly removed. On the other hand, there was observed the fully transferred image of the toner 7 on the releasing member surface layer 23 of the releasing belt 2. When the toner removing process was carried out for the 50 sheets of recording member 8, retransfer of the toner to the recording member 8 from the releasing member surface layer 23 was not recognized and favorable toner removing was performed.

Example 5

As a releasing member, there was formed a black all over image on a polyethylene terephthalate film having a thickness of 150 μm with an electrophotographic laser beam printer "FINE WRITER 401" made by MINOLTA Corporation. The process was repeated for 5 times to form a surface layer of black all over image comprising thick toner material, after which the said sleeve was stored in a high temperature bath at 150° C. to smooth the surface. And, five sheets of the film were joined at their ends with an adhesive to form a seamless releasing belt 2. The full circumference of the resulting releasing belt 2 was 100 cm.

As a recording member 8, there was used a white PET film made by dispersing the fine particles of titanium oxide therein. An image of toner 7 was formed on the recording member 8 with the above FINE WRITER 401. As the toner 7, there was used one having the softening point at 120° C. and SP value of 10.5.

The apparatus of FIG. 5 using the far infrared heater 25*a* as the heating means was used to operate under the same conditions as those of Example 4. When the toner removing process was continuously carried out for the 50 sheets of the recording member 8, retransfer of the toner to the recording member 8 from the releasing member surface layer 23 was not recognized and favorable toner removing was performed.

Comparative Example

As the releasing member surface layer 23 and the recording member 8, the same materials as those of Example 4 were used. As the apparatus, there was used one of the Example 4 with omission of the heating roller 4. In this comparative example, for the first few sheets of recording member 8 the toner 7 was favorably removed, while as to the subsequent recording member 8 the toner 7 transferred to the releasing member surface layer 23 from the recording member 8 was retransferred to the recording member 8. Thus, favorable toner removing was not performed.

As illustrated in the above examples and comparative example, according to the printing material removing apparatus of the present invention, it has been confirmed that retransfer of the toner is prevented and favorable toner removing can be performed.

<Third Embodiment>

Figure 6:
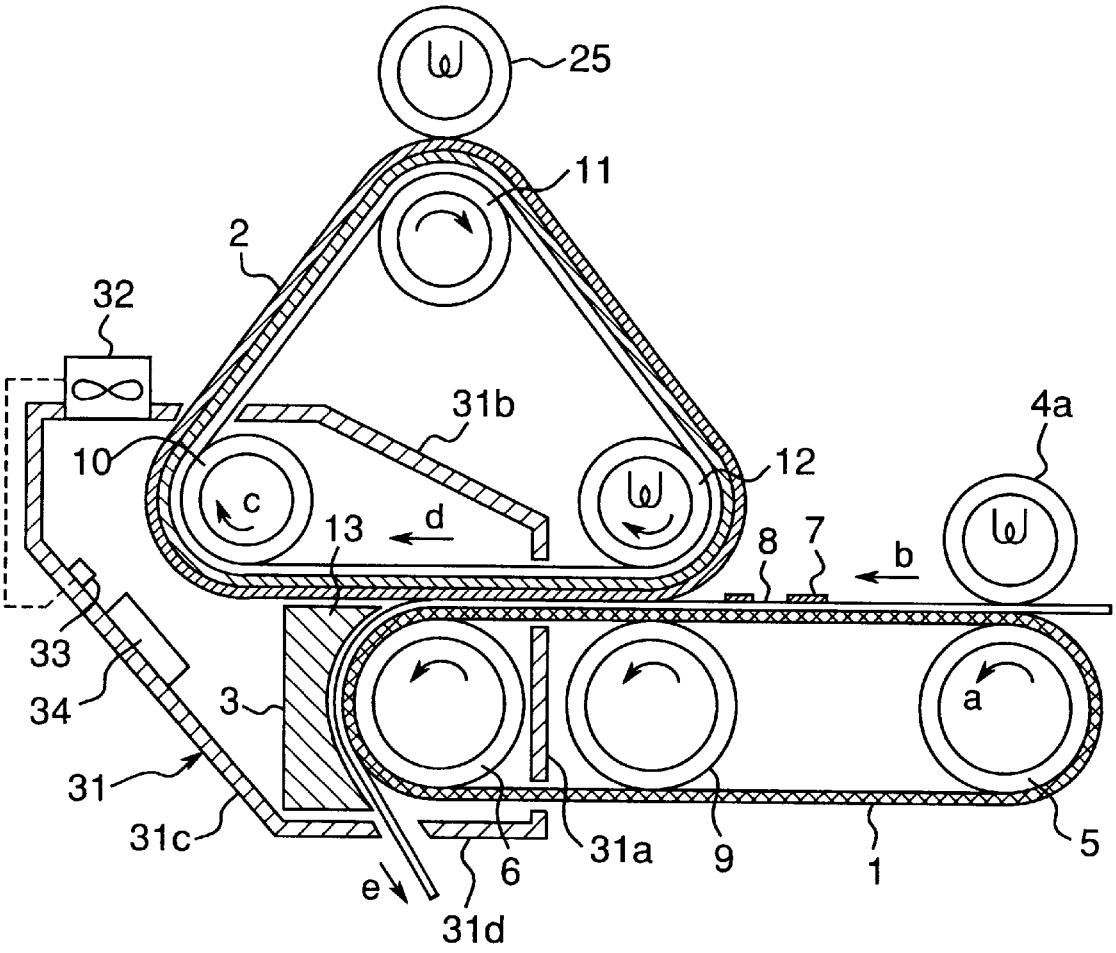
FIG. 6 is a view to show a third embodiment of the printing material removing apparatus of the present invention.

FIG. 6 shows a third embodiment of the printing material removing apparatus of the present invention.

In the third embodiment, the heating roller 4*a* as the heating means for heating the toner 7 on the recording member 8 is provided in the same manner as the first embodiment of FIG. 3. The heating roller 25 as the heating means for heating the toner 7 transferred onto the releasing member surface layer 23 is also provided in the same manner as the second embodiment of FIG. 4. The separation part is surrounded by a heat insulating wall 31 as described in detail hereinafter.

If the toner 7 and the releasing member surface layer 23 reach the separation part under the condition being fused each other to be separated by the separation claw 3, the separation is performed in either fused toner layer or fused resin of the releasing member surface layer 23 because of weak aggregation force between them. Thus, the toner 7 can not be perfectly separated from the recording member 8.

The releasing member surface layer 23 and the recording member 8 are both required to be separated at the temperature lower than 80° C. It is because, if the toner 7 is separated from the recording member 8 at the temperature higher than 80° C., strong force is necessary to release it, making the releasing difficult. Thereby, even if there may be provided the adhesive layer 22 between the release member surface layer 23 and the base layer 21, the releasing member surface layer 23 may be peeled at the 25, interface with the adhesive layer 22 due to the strong releasing force and then transferred to the recording member 8.

The heat insulating wall 31 is to eliminate the above disadvantages.

The heat insulating wall 31 comprises a first wall 31*a* positioned between the driven roller 6 of the transfer belt 1 and the backup roller 9, a second wall 31*b* continued from the first wall 31*a* across the transfer belt 1 and the releasing belt 2 and positioned so as to cover the driving roller 10 inside the releasing belt, a third wall 31*c* continued from the second wall 31*b* across the releasing belt 2 and positioned so as to cover the separation claw 3 out side the releasing belt and the transfer belt 1, and a fourth wall 31*d* continued from the third wall 31*c* across the recording member 8 separated by the separation claw 3 and continued to the fourth wall 31*d* across the transfer belt 1. The separation part is surrounded by these walls of the heat insulating wall 31. The both side ends (both ends on the front and back side in FIG. 6) of the heat insulating wall 31 may be closed so that the heat insulating wall 31 is a half closed structure.

As the heat insulating wall 31, generally used heat insulating material, for example, carbonized cork, felt material, glass fiber, ceramics fiber, polyurethane foam, form rubber, phenol resin form, urea resin form and so on may be used. Also material made by applying silicon rubber to both surfaces of stainless steel plate may be used.

On top portion of the heat insulating wall 31 is provided a fan 32 for emitting the heat within the heat insulating wall 31 to the outside. The fan 32 may be always driven in the course of operation of the apparatus, though it may be driven when a temperature sensor 33 provided on the heat insulating wall 31 detects a predetermined temperature, for example, a temperature of more than 80° C. In addition to the fan 32, a cooling element 34, for example, Peltier effect element can be provided as a cooling means. The cooling element 34 is preferably operated when the temperature sensor 33 detects a predetermined temperature, for example, a temperature of more than 80° C. Either the fan 32 or the cooling element 34 may be provided, or alternatively both of them may be provided.

In operation, the separation part is insulated from the pressure contact part by the heat insulating wall 31, preventing the heat generated by the heating roller 12 in the pressure contact part from transmitting to the separation part. Thus, the fused portion of the toner 7 and the releasing member surface layer 23 is rapidly cooled and solidified, preventing either the fused toner layer or the fused resin of the releasing member surface layer 23 from being separated.

When the temperature inside the heat insulating wall 31 becomes more than 80° C., the temperature sensor 33 detects this, causing the fan 32 or the cooling element 34 to operate to maintain the temperature lower than 80° C. Thus, the toner 7 is easily peeled from the recording member 8.

<Fourth Embodiment>

Figure 7:
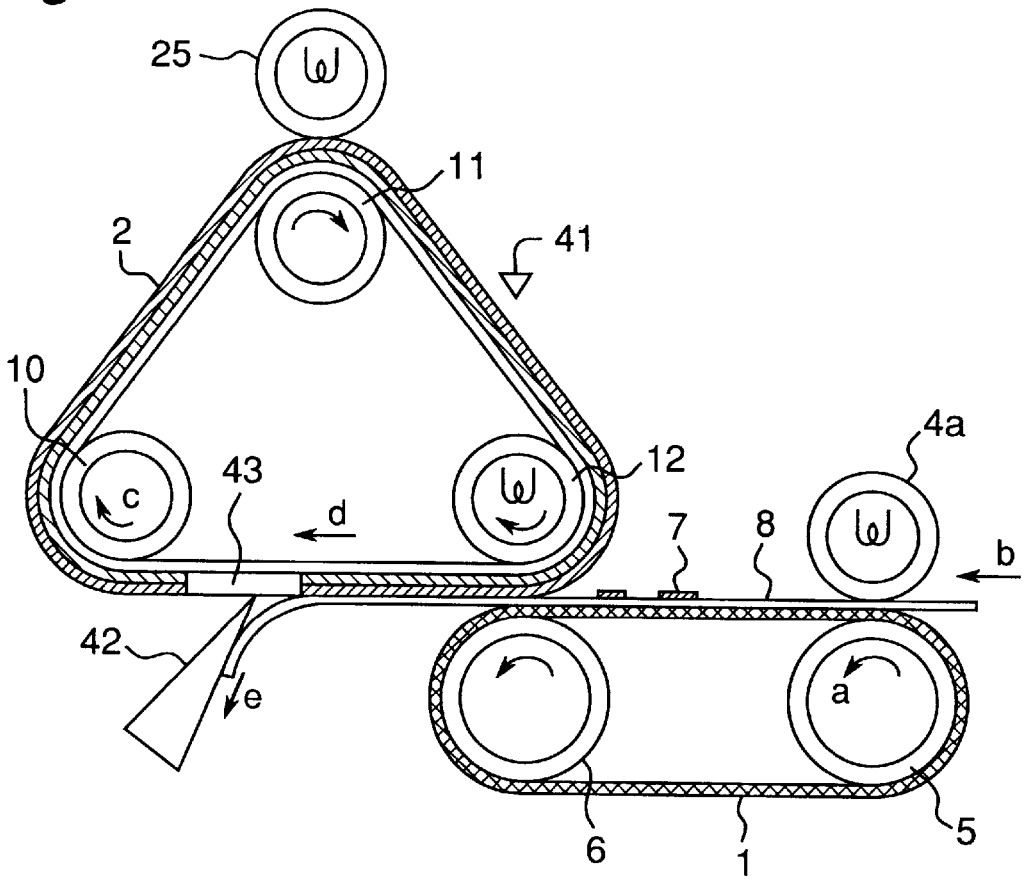
FIG. 7 is a view to show a fourth embodiment of the printing material removing apparatus of the present invention.

FIG. 7 shows a fourth embodiment of the printing material removing apparatus of the present invention.

In the fourth embodiment, the driven roller 6 of the transfer belt 1 is positioned to oppose to the heating roller 12 of the releasing belt 2 and therefore the backup roller 9 as show in the first embodiment of FIG. 1 is not provided.

An appropriate portion opposing to the releasing belt 2 is positioned a sensor 41 for detecting the pass of a releasing portion 43 of the releasing belt 2 as described hereinafter. The sensor 41 is to detect front or rear edge of the releasing portion 43 in the moving direction of the releasing belt 2. Any type of sensor can be used as the sensor 14. The detected signal of the sensor 14 is used to take a timing for feeding the recording member 8 to the transfer belt 1.

Instead of the separation claw 3 of the first embodiment of FIG. 1, a separation blade 42 is provided at a position spaced by a predetermined distance from the pressure contact part between the heating roller 12 of the releasing belt 2 and the driven roller 6 of the transfer belt 1. The separation blade 42 is arranged to separate the recording member 8 from the releasing belt 2.

Figure 8A:
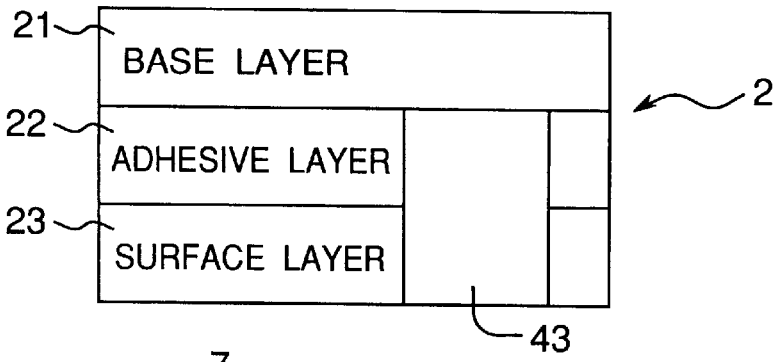
FIGS. 8A and 8B are schematic sectional views showing the constitution of the recording member and the releasing member used in the apparatus of FIG. 7.
Figure 8B:
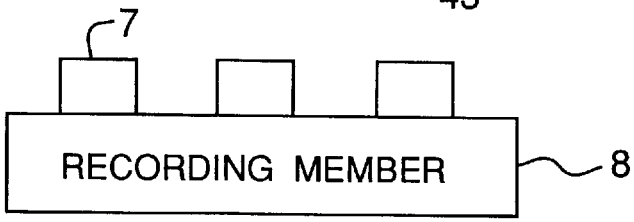

The above releasing portion 43 is provided at one or more than two portions of the releasing member surface layer 23 of the releasing belt 2. The releasing portion 43 extends like a belt to the direction perpendicular to the transferring direction "d" of the releasing belt 2. As shown in FIG. 8A, the releasing portion 43 is formed by masking a part of the base layer 21 of the releasing belt 2 so as not to form the releasing member surface layer 23. In FIGS. 7, 8A and 9, for the sake of convenience, the releasing portion 43 is shown as a space. In actual, however, the releasing portion 43 is a surface exposing the base layer 21. The width of the releasing portion 43 is preferably, for example, 3 mm–30 mm. The number of the releasing portion 43 may be determined in accordance with the size of the recording member 8 to be treated, the total length and transfer velocity of the releasing belt 2 and so on. In the case that a plurality of releasing portion 43 is provided, it is necessary to determine the distance therebetween so that only the front edge of the recording member 8 corresponds to the releasing portion 43. Because, in the case where the intermediate portion of the recording member 8 overlaps with the releasing portion 43, the toner 7 on the intermediate portion is not removed.

Figure 9A:
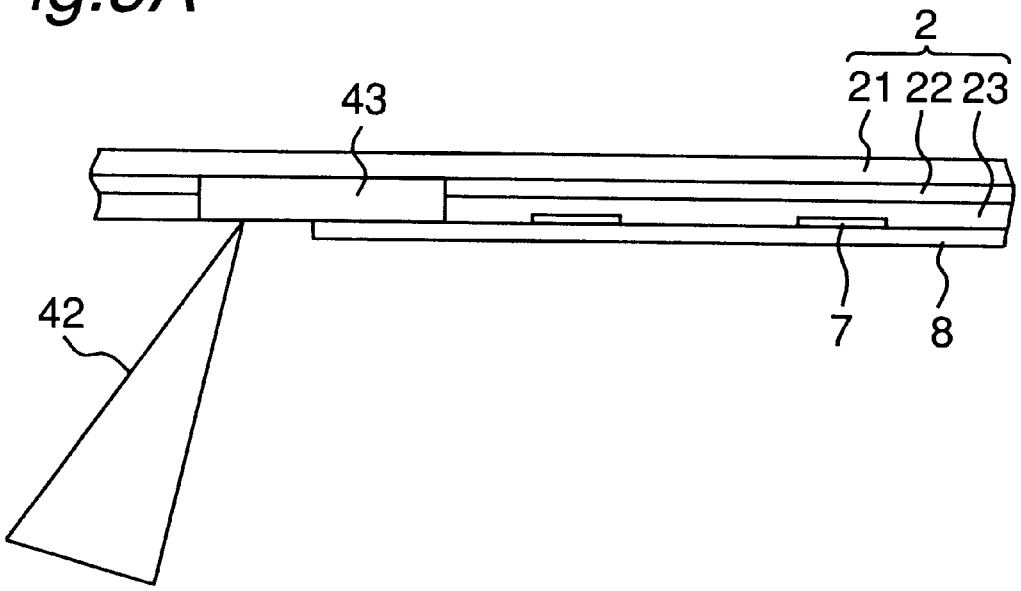
FIGS. 9A and 9B are views showing a state of overlap of the recording member and the releasing portion in the apparatus of FIG. 7 and a state of separating the recording member from the releasing member by a separation blade in the apparatus of FIG. 7 respectively.

In operation, when the sensor 41 detects the releasing portion 43 of the releasing belt 2, the recording member 8 is fed to the transfer belt 1. When the recording member 8 is transferred on the transfer belt 1 in the direction of arrow "b" and inserted into the opposite portion to the releasing belt 2, the front end portion of the recording member 8 overlaps with the releasing portion 43 of the releasing belt 2 as shown in FIG. 9A. If the overlapping length of the front end portion of the recording member 8 and the releasing portion 43 is too short, the separation effect would be weakened. And if the overlapping length is too long, the toner 7 in the area of overlapping portion would not be removed. Therefore, the overlapping length is preferably more than 3 mm and less than 20 mm. The limitation of 20 mm is set because there is little document which has a printed area of 20 mm at the front end portion.

Figure 9B:
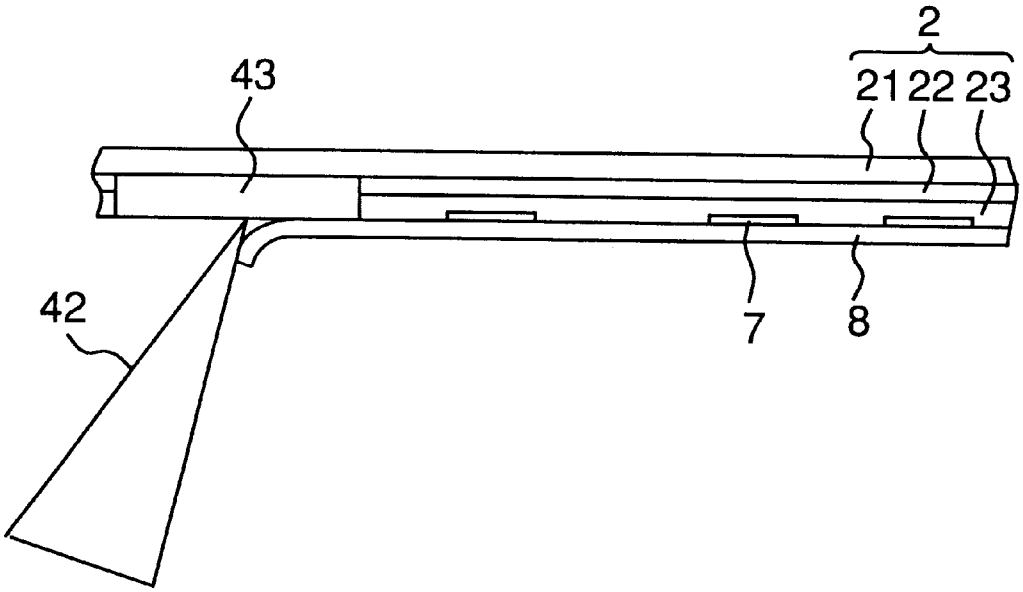

When the front end of the recording member 8 reaches the separation blade 42, the tip end of the separation blade 42 penetrates into the interface between the releasing portion 43 of the releasing belt 2 and the recording member 8 as shown in FIG. 9B. The releasing portion 43 has a good releaseness against the recording member 8, allowing the recording member 8 to be easily separated from the releasing belt 2. The recording member 8 separated from the releasing belt 2 is then bent in a arc like state with respect to the releasing member surface layer 23 by the separation blade 42. As a result, a bending force is applied to the recording member 8 and a shear force is generated between the surface of the recording member 8 and the toner 7, causing the toner 7 to be surely peeled.

Because of the easiness of separating the recording member as described above, there is no necessity for bringing the separation blade 3 into highly pressure contact with the releasing member surface layer 23. Thus the load against the releasing member surface layer 23 is reduced and the scraping of the resin of the releasing member surface layer 23 is prevented, allowing the releasing belt 2 to show toner removing function for long period.

In the above described embodiment, the releasing portion 43 is formed by masking a part of the base layer 21 of the releasing belt 2 so as not to form the releasing member surface layer 23. However, the releasing portion 43 can be also formed by forming the releasing member surface layer 23 over the whole circumferential length and then removing a part of the surface layer 23 to expose the base layer 21.

Figure 10:
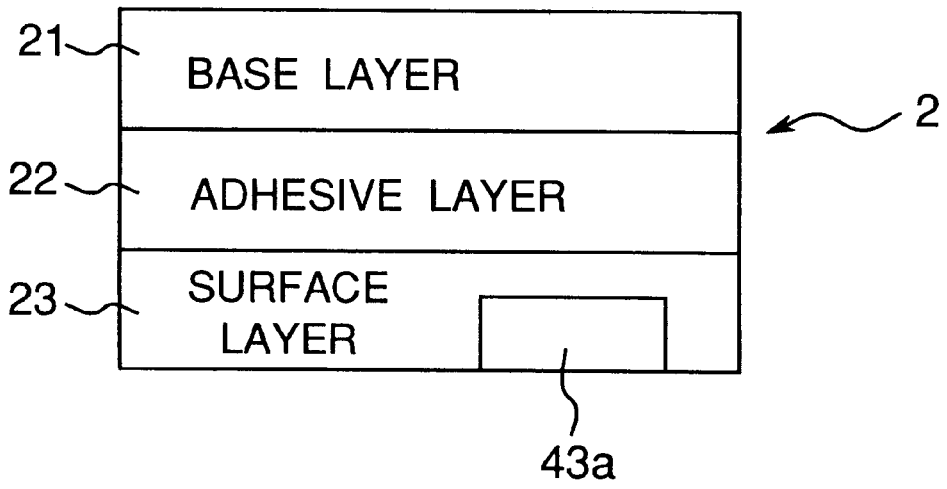
FIG. 10 is a schematic sectional view showing a variation of the constitution of the releasing member used in the apparatus of FIG. 7.

Moreover, a releasing portion 43*a* may be formed, as shown in FIG. 10, by removing the releasing member surface layer 23 by a predetermined depth from it surface and then applying the surface with releasing agent of high releaseability, for example, high molecular compound of silicon, polypropylene, polyethylene or fluorine.

Figure 11:
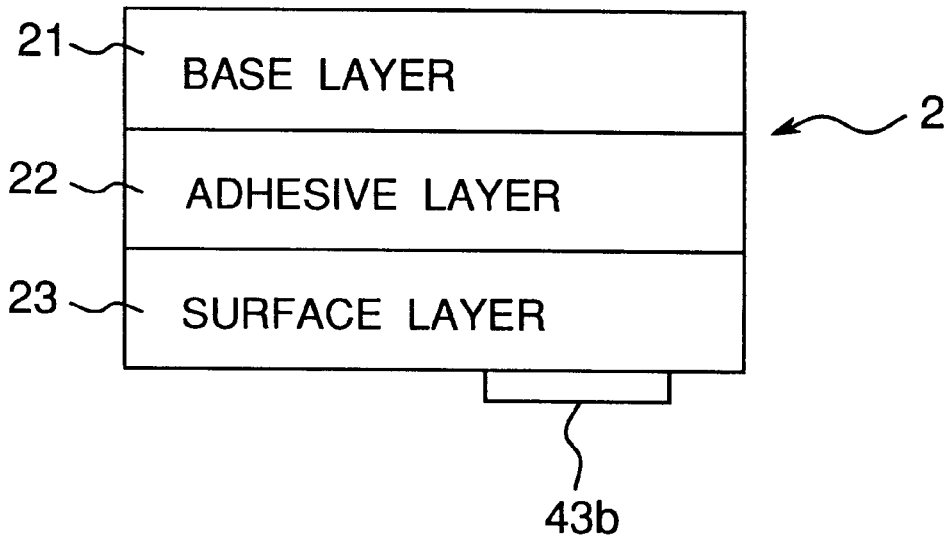
FIG. 11 is a schematic sectional view showing an another variation of the constitution of the releasing member used in the apparatus of FIG. 7.

Alternatively, a releasing portion 43*b* may be formed, as shown in FIG. 11, by applying the surface of the releasing member surface layer 23 with the releasing agent as described above.

<Fifth Embodiment>

Figure 12:
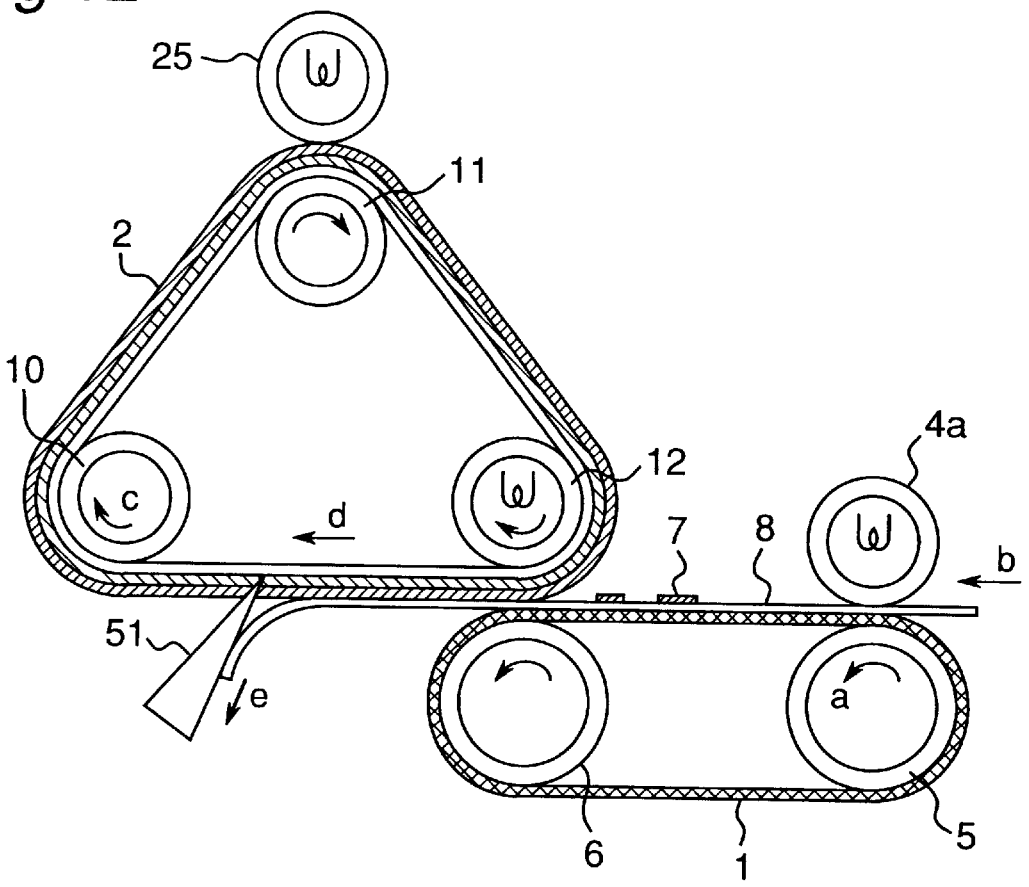
FIG. 12 is a view to show a fifth embodiment of the printing material removing apparatus of the present invention.

FIG. 12 shows a fifth embodiment of the printing material removing apparatus of the present invention.

In the fifth embodiment, instead of the separation blade 42 of the fourth embodiment of FIG. 7, a pair of separation blades 51 are provided. The pair of separation blades 51 are positioned on both side ends of the releasing belt 2 as shown in FIG. 14 and arranged to separate the recording member 8 from the releasing belt 2.

Figure 13A:
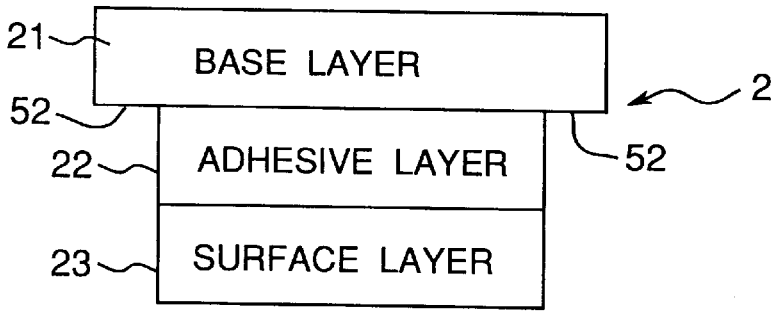
FIGS. 13A and 13B are schematic sectional views showing the constitution of the recording member and the releasing member used in the apparatus of FIG. 12.
Figure 13B:
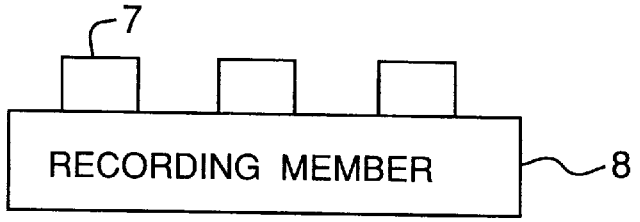
Figure 14:
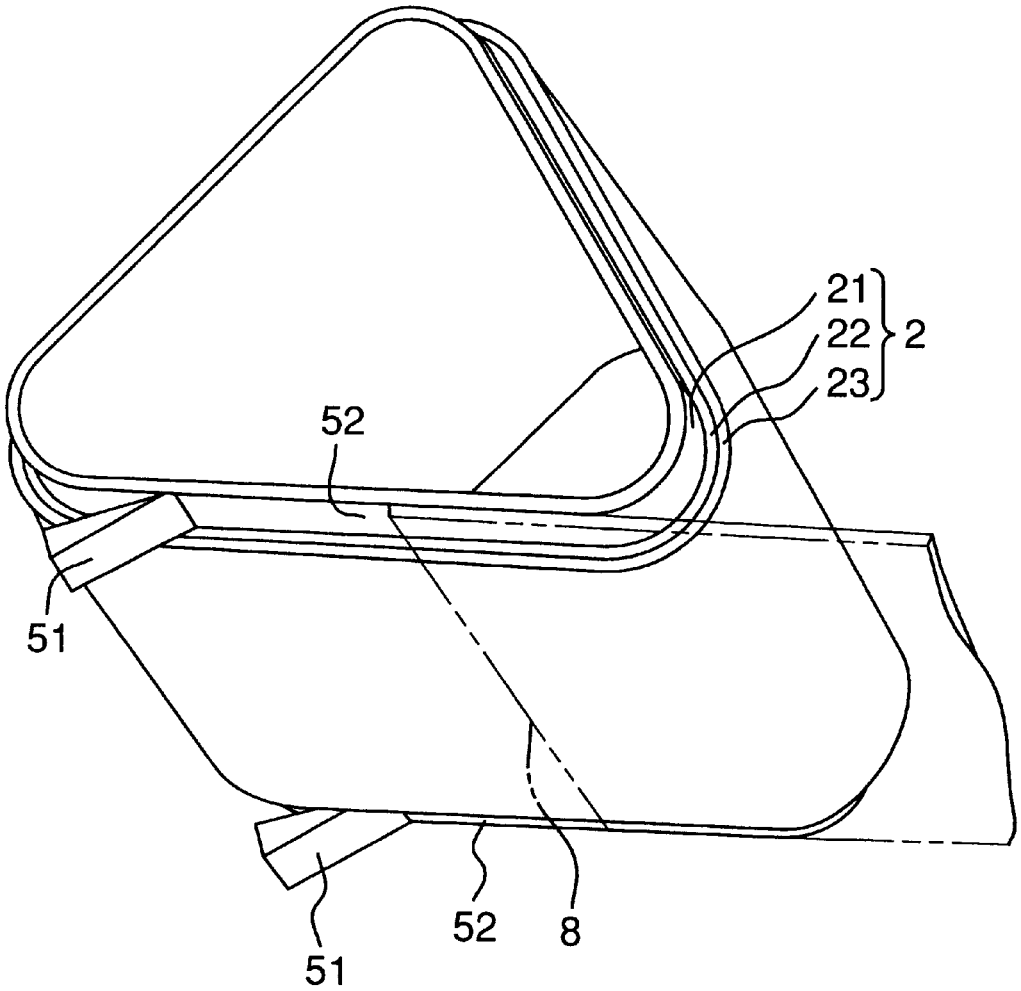
FIG. 14 is a perspective view showing the releasing belt and the separation blade of FIG. 12.

At the both sides end of the releasing member surface layer 23 of the releasing belt 2, releasing portions 52 are provided over the whole circumferential length of the releasing belt 2 as shown in FIGS. 13A and 14. As shown in FIG. 13A, the releasing portions 52 are formed by masking the both side end portions of the base layer 21 of the releasing belt 2 so as not to form the releasing member surface layer 23. The width of each releasing portion 52 is preferably, for example, more than 3 mm and less than 30 mm. The limitation of 20 mm is set because there is little document which has a printed area of 20 mm at the both side end portions.

Figure 15A:
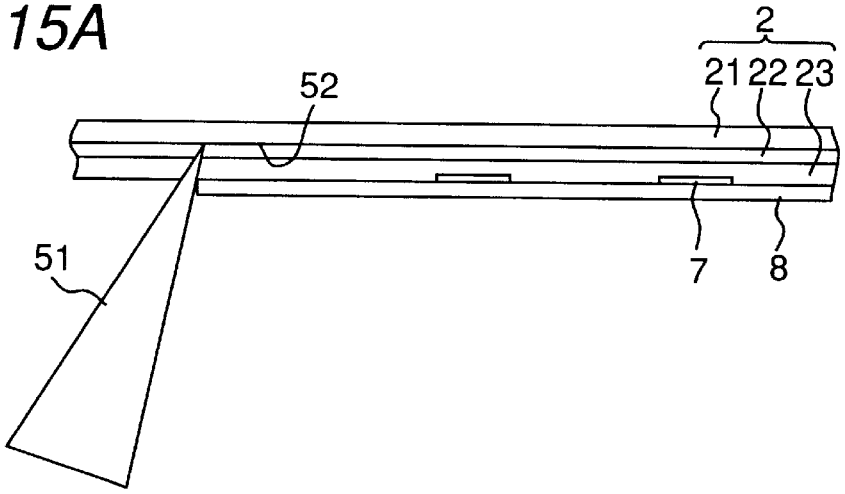
FIGS. 15A and 15B are views showing a state of overlap of the recording member and the releasing portion in the apparatus of FIG. 12 and a state of separating the recording member from the releasing member by a separation blade in the apparatus of FIG. 12 respectively.
Figure 15B:
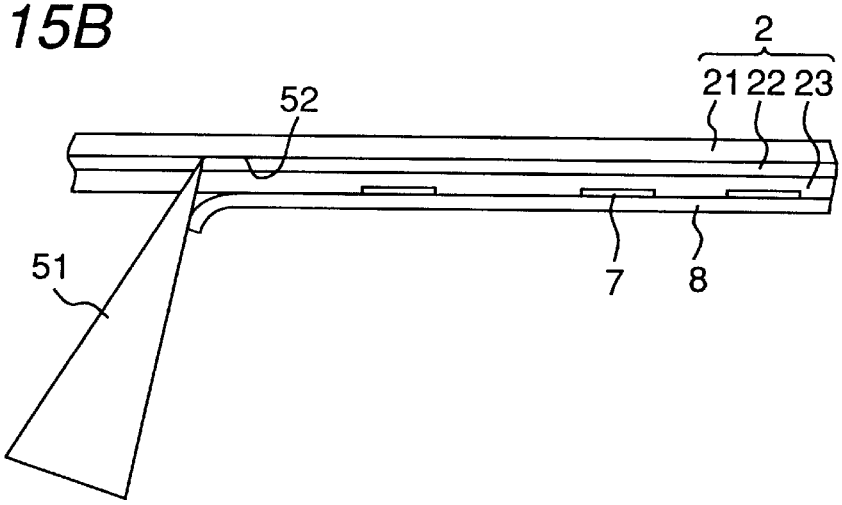

In operation, when the front end of the recording member 8 reaches the separation blades 51, the tip end of the separation blades 51 penetrate into the interface between the releasing portions 52 of the releasing belt 2 and the recording member 8 as shown in FIGS. 15A and 15B. The releasing portions 52 have a good releaseness against the recording member 8 respectively, allowing the recording member 8 to be easily separated from the releasing belt 2. The recording member 8 separated from the releasing belt 2 is then bent in a arc like state with respect to the releasing member surface layer 23 by the separation blades 51. As a result, a bending force is applied to the recording member 8 and a shear force is generated between the surface of the recording member 8 and the toner 7, causing the toner 7 to be surely peeled.

Because of the easiness of separating the recording member as described above, there is no necessity for bringing the separation blades 51 into highly pressure contact with the releasing member surface layer 23. Thus the load against the releasing member surface layer 23 is reduced and the scraping of the resin of the releasing member surface layer 23 is prevented, allowing the releasing belt 2 to show toner removing function for long period.

In the above described embodiment, the releasing portion 52 is formed by masking both side end portions of the base layer 21 of the releasing belt 2 so as not to form the releasing member surface layer 23. However, the releasing portions 52 can be also formed by forming the releasing member surface layer 23 over the whole circumferential length and then removing the both side end portions of the surface layer 23 to expose the base layer 21.

Figure 16:
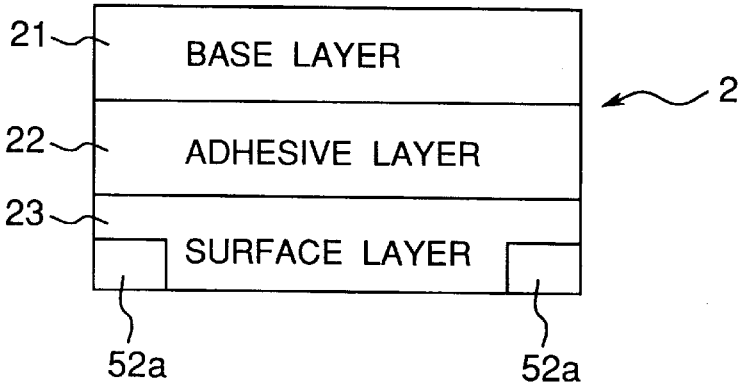
FIG. 16 is a schematic sectional view showing a variation of the constitution of the releasing member used in the apparatus of FIG. 12.

Moreover, releasing portions 52*a* may be formed, as shown in FIG. 16, by removing the releasing member surface layer 23 by a predetermined depth from it surface and then applying the surface with releasing agent as described in the fourth embodiment above.

Figure 17:
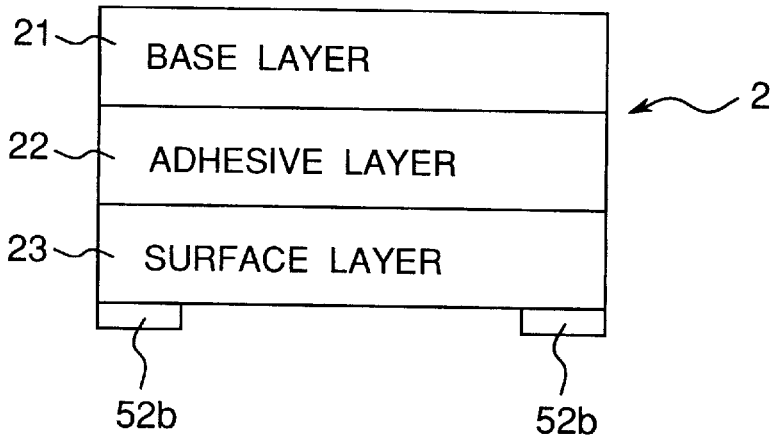
FIG. 17 is a schematic sectional view showing an another variation of the constitution of the releasing member used in the apparatus of FIG. 12.

Alternatively, releasing portions 52*b* may be formed, as shown in FIG. 17, by applying the surface of the releasing member surface layer 23 with the releasing agent as described above.

Figure 18:
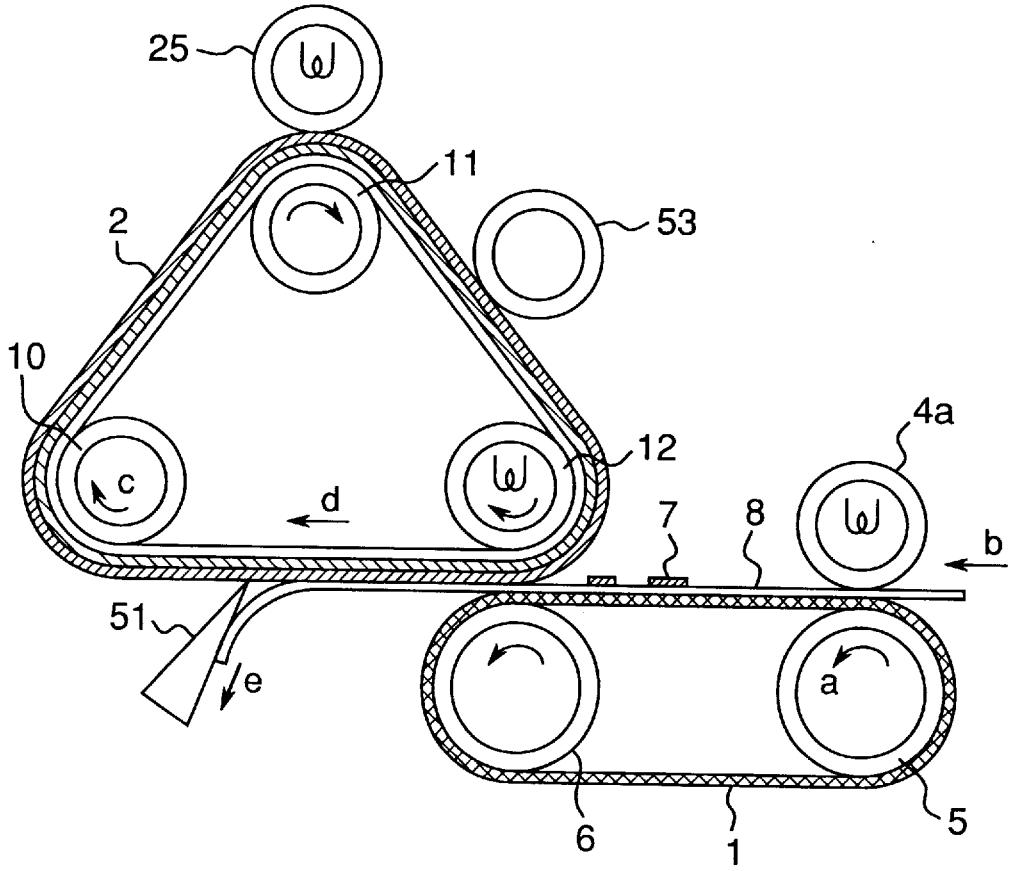
FIG. 18 is a view showing a variation of the fifth embodiment of the printing material removing apparatus of FIG. 12.

As a method for applying the releasing agent, an application by roller, brush or the like is considered but it is not restricted to this. In the case of roller application, as shown in FIG. 18, an applying roller 53 can be provided so as to come into pressure contact with the releasing belt 2. Thus, when the releasing portions 52*b* are worn due to the long period operation, the releasing portions 52*b* can be regenerated by the applying roller 14.

<Sixth Embodiment>

Figure 19:
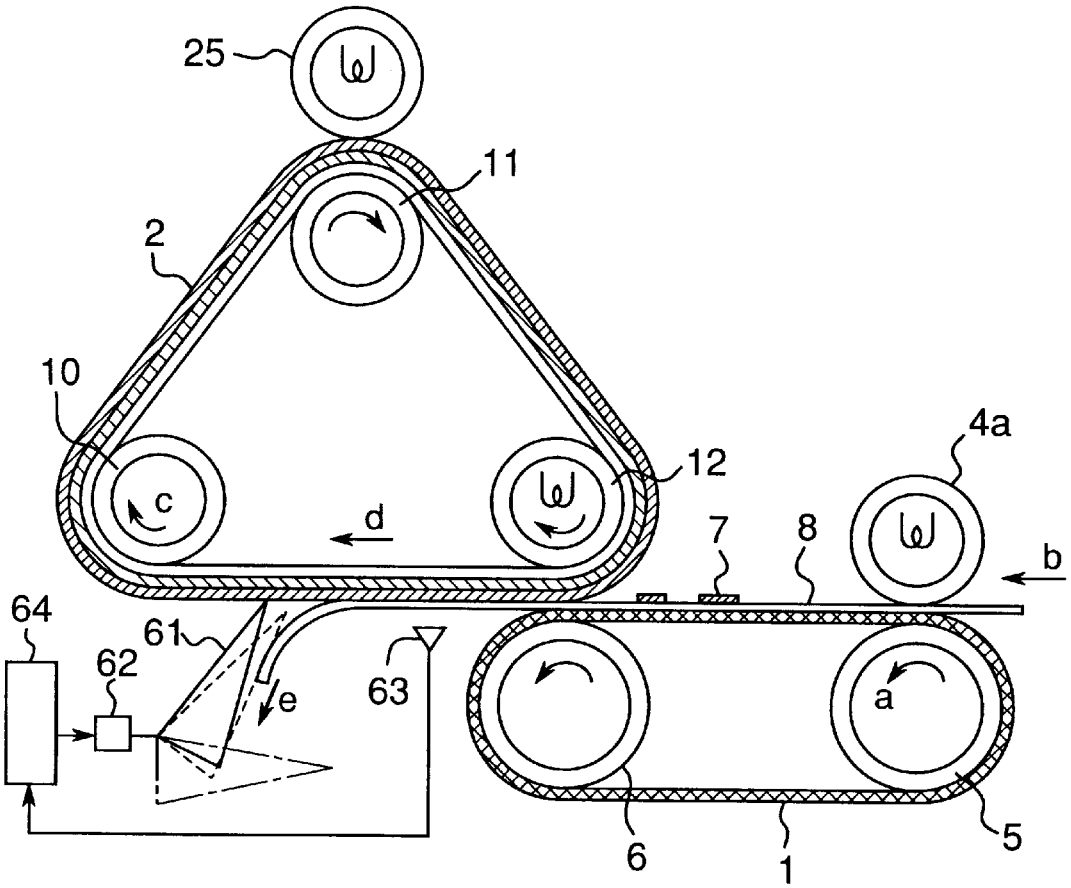
FIG. 19 is a view showing a sixth embodiment of the printing material removing apparatus of the present invention.

FIG. 19 shows a sixth embodiment of the printing material removing apparatus of the present invention.

In the sixth embodiment, instead of the separation blade 42 of the fourth embodiment of FIG. 7, a movable separation blade 61 is provided. The separation blade 61 is arranged to separate the recording member 8 from the releasing belt 2. The separation blade 61 is movable by an actuator 62 to a pressure contact position where the separation blade 61 comes into pressure contact with the releasing belt 2 as shown by a solid line in FIG. 19, a retreat position where the separation blade 61 retreats from the releasing belt 2 as shown by a broken line in FIG. 19, and a perfect retreat position where the separation blade 61 perfectly retreats from the releasing belt 2 as shown by a one-dot chain line in FIG. 19.

Upstream side of the separation blade 3 is positioned a sensor 63 for detecting the front end of the recording member 8. Any type can be used as the sensor 63. The detection signal of the sensor 63 is input to the control unit 64 which in turn drives the actuator 62 of the separation blade 61 based on the detection signal of the sensor 63.

In the sixth embodiment, the releasing belt 2 has no releasing portion as shown in FIG. 7 or 12.

Figure 20A:
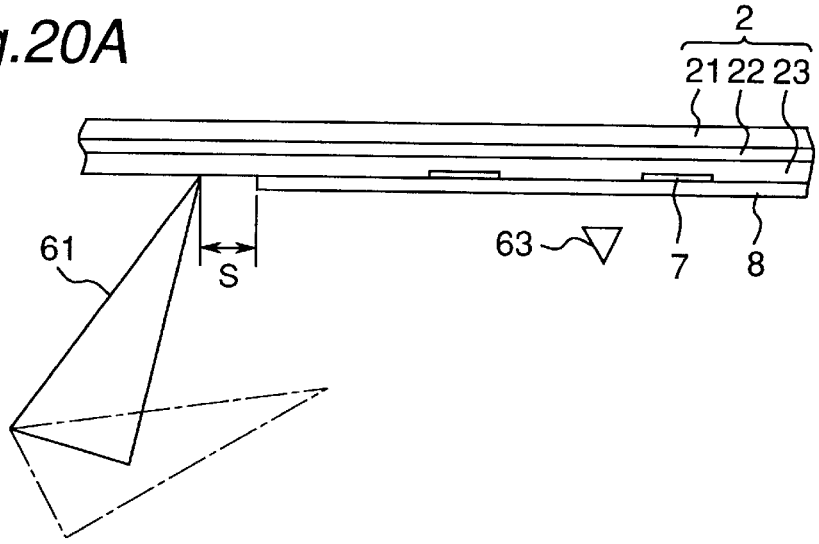
FIGS. 20A, 20B and 20C are views sequentially showing an operation of the separation blade of FIG. 19.
Figure 20B:
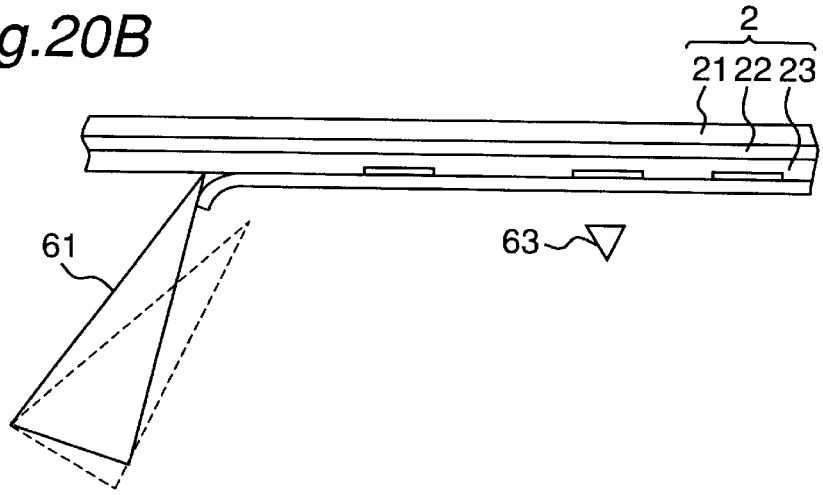
Figure 20C:
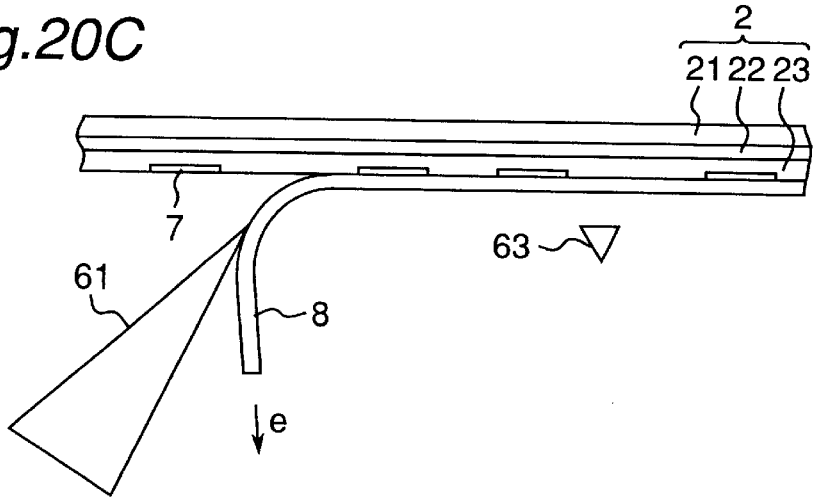

In operation, when the predetermined time "t" has passed since the sensor 63 detected the front end of the recording member 8, the front end of the recording member 8 reaches a point of predetermined distance S to the separation blade 61 as shown in FIG. 20A. At this time, the control unit 64 outputs a drive signal to the actuator 62. Thus, the separation blade 61 moves to the pressure contact position as show by the solid line from the perfect retreat position as shown by one-dot chain line. Whereby, the front end of the separation blade 61 comes into pressure contact with the releasing member surface layer 23 of the releasing belt 2. Then, as soon as the front end of the recording member 8 reaches the separation blade 3 and the front end portion thereof separated from the releasing member surface layer 23 of the releasing member 2 as shown in FIG. 20B, the control unit 64 outputs a drive signal to the actuator 62 of the separation blade 61. Whereby, the separation blade 61 moves to the retreat position as shown by broken line. As a result, as shown in FIG. 20C, the recording member 8 is guided in the direction of arrow "e" and discharged.

By regulating the retreat position of the separation blade 61, the discharge direction can be changed. The recording member 8 separated from the releasing belt 2 is then bent in a arc like state with respect to the releasing member surface layer 23 by the separation blades 61. As a result, a bending force is applied to the recording member 8 and a shear force is generated between the surface of the recording member 8 and the toner 7, causing the toner 7 to be surely peeled.

As described above, the separation blade 61 comes into pressure contact with the releasing member surface layer 23 of the releasing belt 2 for only a little time, i.e., until the front end portion of the recording member 8 is slightly separated since it reaches the point of predetermined distance S to the separation blade 61. Thus, the load against the releasing member surface layer 23 is reduced and the scraping of the resin of the releasing member surface layer 23 is prevented, allowing the releasing belt 2 to show toner removing function for long period.

<Seventh Embodiment>

Figure 21:
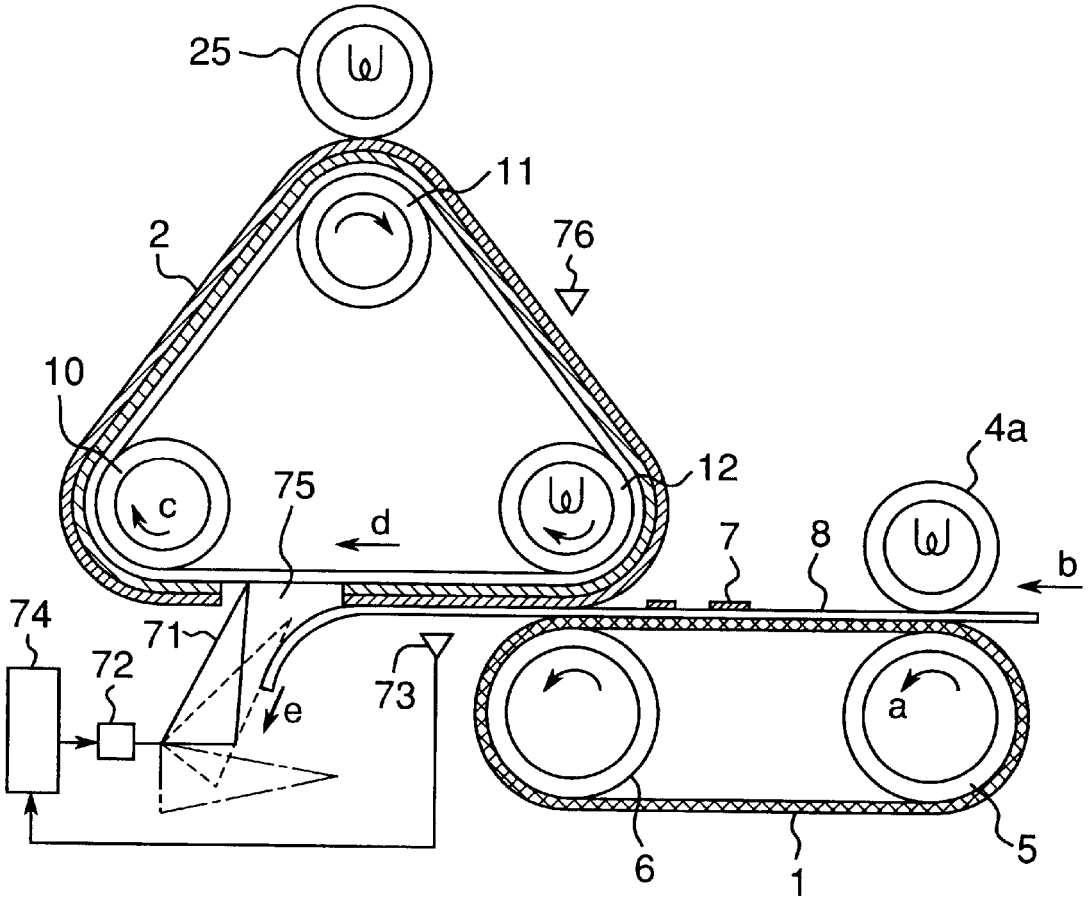
FIG. 21 is a view showing a seventh embodiment of the printing material removing apparatus of the present invention.

FIG. 21 shows a seventh embodiment of the printing material removing apparatus of the present invention.

In this embodiment, a separation blade 71, an actuator 72, a sensor 73, and a control unit 74 are provided in the same manner as that of the sixth embodiment of FIG. 19.

In addition, at one or more than two portions of the releasing member surface layer 23 of the releasing belt 2, a releasing portion 75 is provided in the same manner as the releasing portion 43 of the fourth embodiment of FIG. 7. An appropriate portion opposing to the releasing belt 2 is positioned a sensor 76 in the same manner as the sensor 41 of the fourth embodiment of FIG. 7.

In operation, when the sensor 76 detects the releasing portion 75 of the releasing belt 2, the recording member 8 is fed to the transfer belt 1. When the recording member 8 is transferred on the transfer belt 1 in the direction of arrow "b" and inserted into the opposite portion to the releasing belt 2, the front end portion of the recording member 8 overlaps with the releasing portion 75 of the releasing belt 2 as shown in FIG. 22A.

Figure 22A:
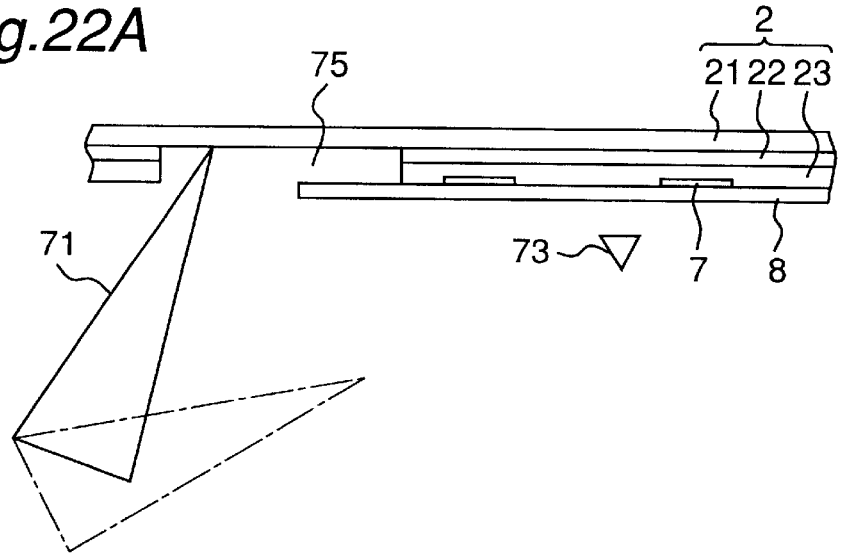
FIGS. 22A, 22B and 22C are views sequentially showing an operation of the separation blade of FIG. 21.
Figure 22B:
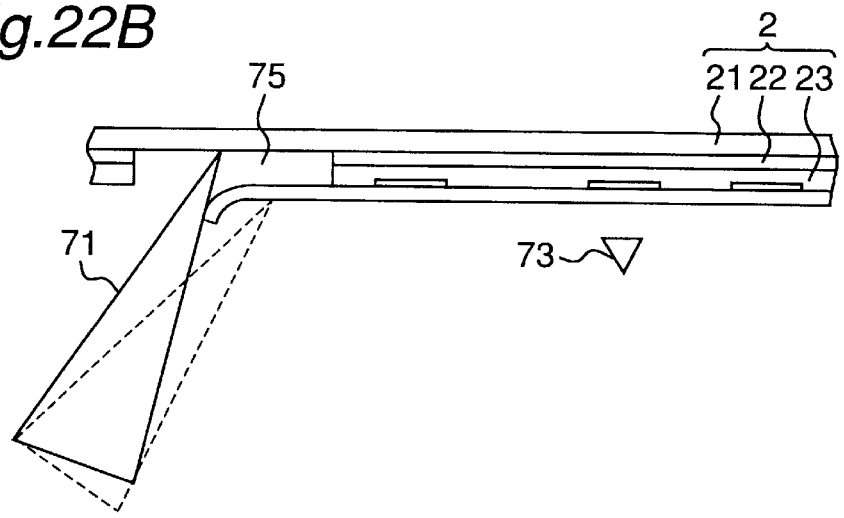
Figure 22C:
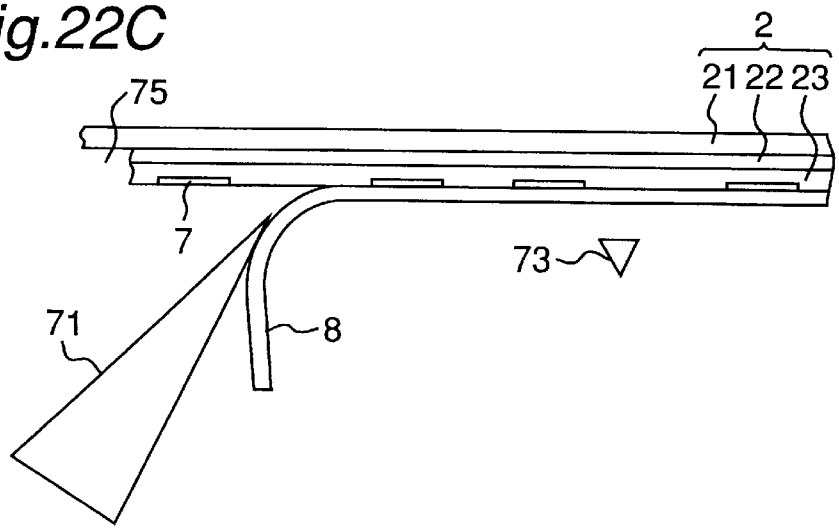

The operation of the separation blade 3 as shown in FIGS. 22A to 22C is same as the sixth embodiment of FIGS. 20A to 20C and therefore description will be omitted. In particular, as the front end of the releasing blade 71 comes into contact with the base layer of the releasing belt 2, no load against the releasing member surface layer 23 is applied. Therefore, no scraping of the resin of the releasing member surface layer 23 occurs, allowing the releasing belt 2 to show toner removing function for long period.

<Eighth Embodiment>

Figure 23:
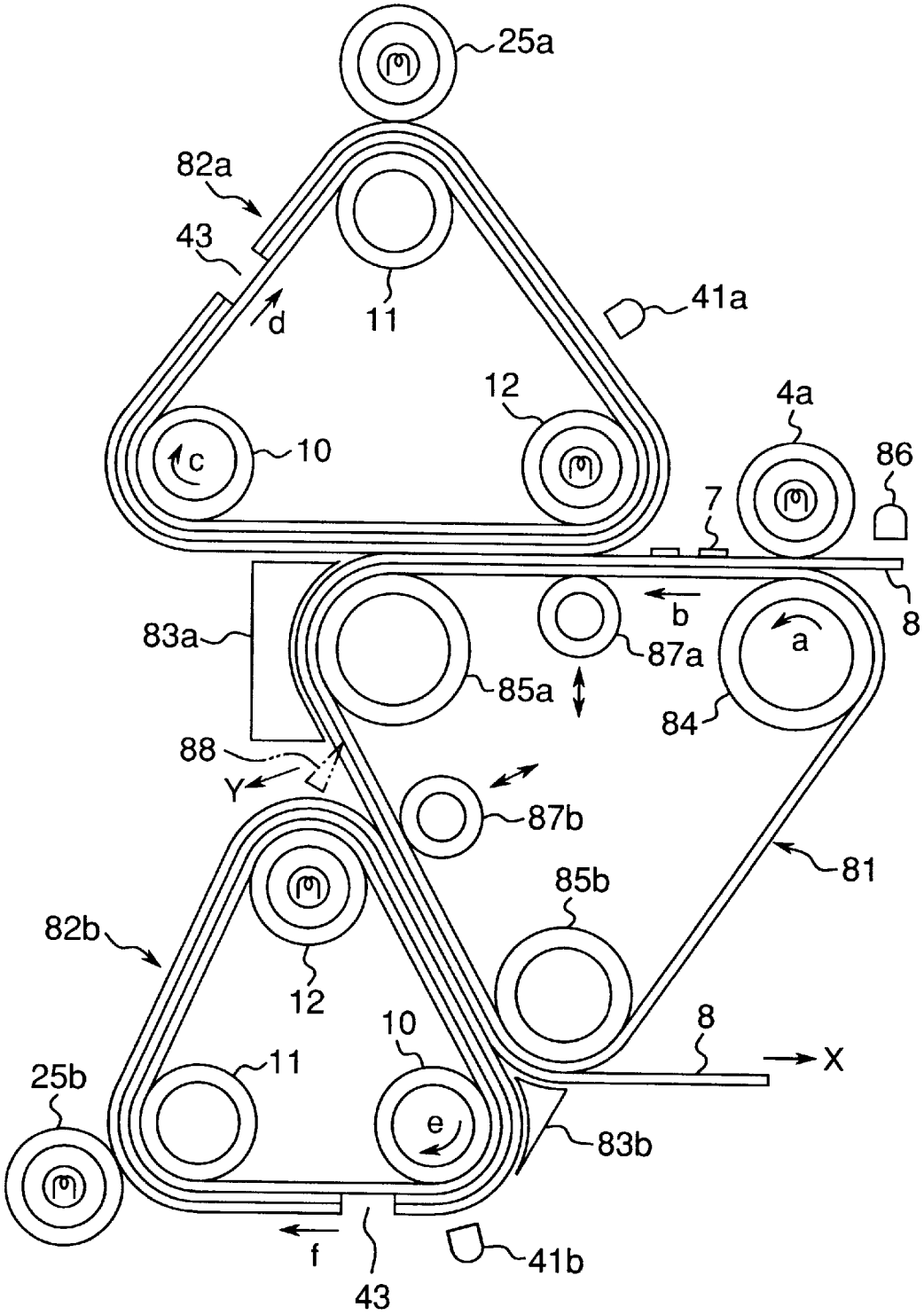
FIG. 23 is a view showing an eighth embodiment of the printing material removing apparatus of the present invention.

FIG. 23 shows an eighth embodiment of the printing material removing apparatus of the present invention.

The printing material removing apparatus comprises a transfer belt 81, a first releasing belt 82*a*, a second releasing belt 82*b*, a first separation claw 83*a* and a second separation belt 83*b*.

The transfer belt 81 is borne on a driving roller 84 and two driven roller 85*a* and 85*b* which are disposed in triangle relations. The transfer belt 81 is movable in the direction of arrow "b" according to the rotation of the driving roller 84 in the direction of arrow "a". The transfer belt 81 can transfer a recording member 8, on which printing material 7 is fixed to form a picture image, horizontally in the direction of arrow "b".

Above the driving roller 84, the heating roller 4*a* for heating the printing material 7 on the recording member 8 as described in the first embodiment of FIG. 3 is disposed.

On the upstream side of the transferring direction with respect to the opposite portion between the driving roller 84 and the heating roller 4*a*, there is disposed a sensor 86 for detecting the front end of the recording member 8. Any type can be used as the sensor 86.

Figure 24A:
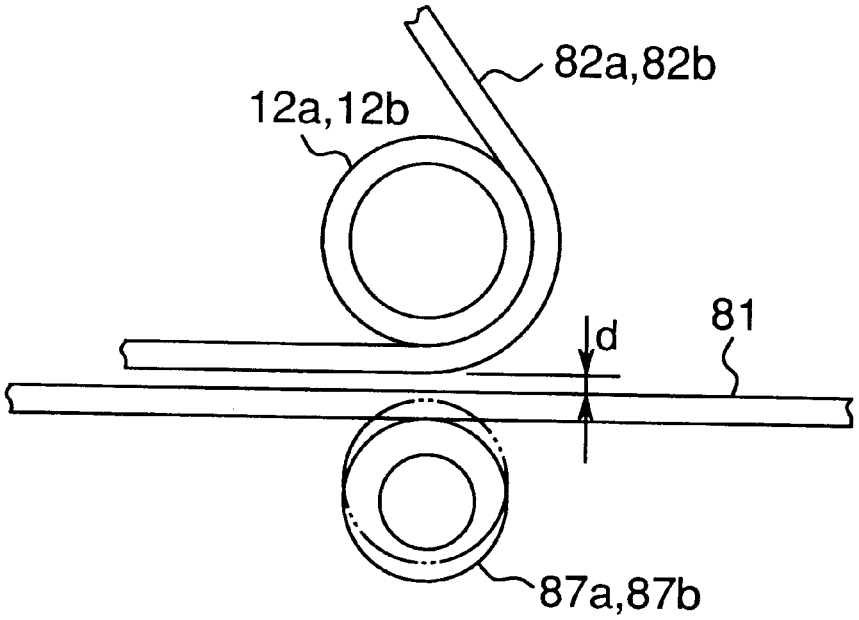
FIGS. 24A and 24B are enlarged views sequentially showing an operation of the pressure contact roller of the apparatus of FIG. 23.
Figure 24B:
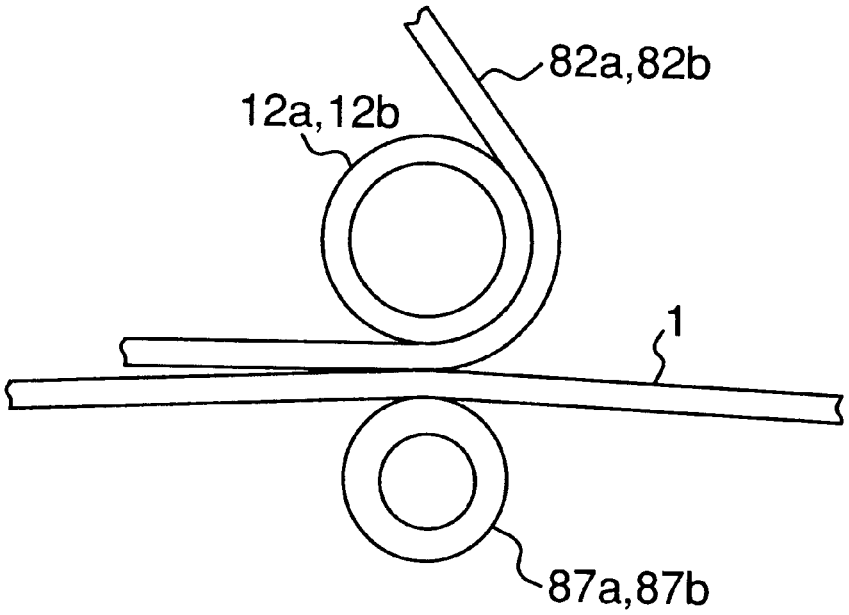

Between the driving roller 84 and the driven roller 85*a* and between the driven rollers 85*a*, 85*b*, there are disposed a first pressure contact roller 87*a* and a second pressure contact roller 87*b*. The pressure contact rollers 87*a*, 87*b* are movable in the direction perpendicular to the surface of the transfer belt 81 by unshown driving means, for example, a solenoid and so on. The pressure contact rollers 87*a*, 87*b* can be positioned in a retreat position where the transfer belt 81 retreats from the releasing belt 82*a*, 82*b* as shown in FIG. 24A, and a pressure contact position where the transfer belt 81 comes into pressure contact with the releasing belt 82*a*, 82*b* as shown in FIG. 24B.

The first releasing belt 82*a* and the second releasing belt 82*b* are the same structure as the releasing belt 2 in the fourth embodiment of FIG. 7. The length of the second releasing belt 82*b* is shorter than that of the first releasing belt 82*b*. The first releasing belt 82*a* and the second releasing belt 82*b* are disposed so that the heating rollers 12 thereof are opposed to the first and second pressure contact rollers 87*a*, 87*b* of the transfer belt 81 (hereinafter, these portions are referred to "first pressure contact part", "second pressure contact part" respectively), and that a part of the belt portion between the heating roller 12 and the driving roller 10 is opposed to the transfer belt 81. The distance "d" between the releasing belt 82*a*, 82*b* and the transfer belt 81, as shown in FIG. 24A, is set to an extent of the thickness of the recording member 8 (substantially, 0.1–0.2 mm) when the 7; first pressure contact roller 87*a*, 87*b* is in the retreat position.

The first releasing belt 82*a* and the second releasing belt 82*b* have the releasing portion 43 respectively in the same manner as in the fourth embodiment of FIG. 7. In the case that a plurality of the releasing portions 43 are provided, it is necessary to differentiate the distance between the releasing portions 43 of the first releasing belt 82*a* from the distance between the releasing portions 43 of the second releasing belt 82*b*. In the case that one releasing portion 43 is provided, the distance between the releasing portions 43 corresponds to the circumferential length of the releasing belt, and therefore it is necessary to differentiate the circumferential of the first releasing belt 82*a* from the circumferential length of the second releasing belt 82*b*.

The first releasing belt 82*a* and the second releasing belt 82*b* have the heating roller 25*a*, 25*b* and the sensor 41*a*, 41*b* respectively in the same manner as in the fourth embodiment of FIG. 7. The position of the sensor 41*a* of the first releasing belt 82*a* is set so that a time that the releasing portion 43 detected by the sensor 41*a* reaches the first pressure contact part coincides with a time that the front end of the recording member 8 detected by the sensor 86 reaches the first pressure contact part. Similarly, the position of the sensor 41*b* of the second releasing belt 82*b* is set so that a time that the releasing portion 43 detected by the sensor 41*b* reaches the second pressure contact part coincides with a time that the front end of the recording member 8 detected by the sensor 86 reaches the second pressure contact part.

The first separation claw 83*a* is disposed in a portion apart from the first pressure contact part by a predetermined distance and downstream the opposite part between the driven roller 85*a* and the first releasing belt 82*a* (hereinafter, this part is referred to "first separation part"). The first separation claw 83*a* is to separate the recording member 8 adhered to the first releasing belt 82*a* from the first releasing belt 82*a*.

Similarly, the second separation claw 83*b* is disposed in a portion apart from the second pressure contact part by a predetermined distance and downstream the opposite part between the driven roller 85*b* and the second releasing belt 82*b* (hereinafter, this part is referred to "second separation part"). The second separation claw 83*b* is to separate the recording member 8 adhered to second the releasing belt 82*b* from the second releasing belt 82*b*.

In operation, in a state that the first and second pressure contact rollers 87*a*, 87*b* move to the retreat position respectively and the transfer belt 81 comes to stop, the first and second releasing belts 82*a* and 82*b* are driven to operate. When the sensor 41*a* of the first releasing belt 82*a* detects the releasing portion 43 thereof, the first releasing belt 82*a* is halted. When the sensor 41*b* of the second releasing belt 82*b* subsequently detects the releasing portion 43 thereof, the second releasing belt 82*b* is halted. In this state, the apparatus is standing by until the recording member 8 is fed.

Figure 25A:
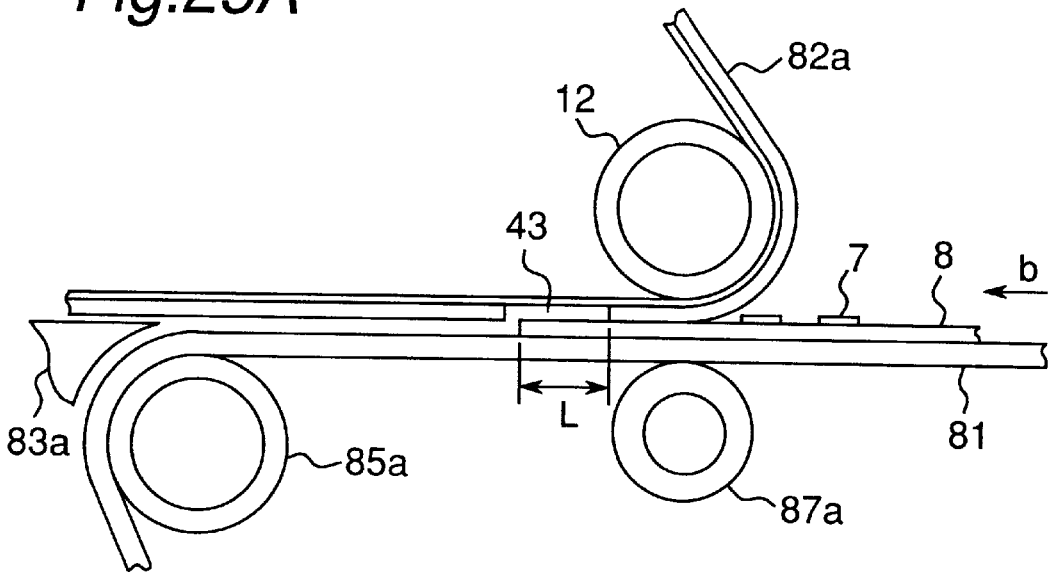
FIGS. 25A and 25B are views showing a state of overlap of the recording member and the releasing portion in the apparatus of FIG. 23 and a state of separating the recording member from the releasing member by a separation claw in the apparatus of FIG. 23 respectively.
Figure 25B:
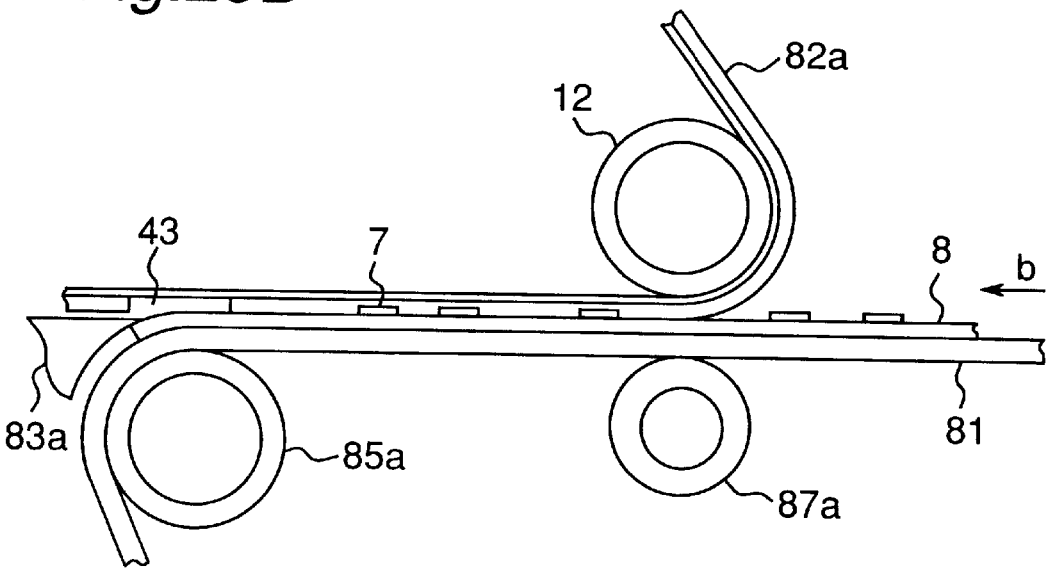

When the recording member 8 is supplied to the transfer belt 1 and the front end of the recording member 8 is detected by the sensor 86, the first and second pressure contact rollers 87*a*, 87*b* are moved to the pressure contact position respectively and the first and second releasing belts 82*a*, 82*b* are driven respectively. Thus, at the timing that the front end of the recording member 8 reaches the first pressure contact part, the releasing portion 43 of the first releasing belt 83*a* reaches the first pressure contact part. Therefore, as shown in FIG. 25A, the front end of the recording member 8 overlaps with the releasing portion 43 of the first releasing belt 82*a* and enters into the first pressure contact part. Then, when the front end of the recording member 8 reaches the first separation part, the recording member 8 is separated by the first separation claw 83*a* from the first releasing belt 83*a* as shown in FIG. 25B.

Considering the case that the length of the recording member 8 in the transferring direction thereof is longer than the first releasing belt 82*a*, after being released from the front end of the recording member 8, the releasing portion 43 of the first releasing belt 82*a* moves around and comes into contact with the same recording member 8 again. As a result, a non-released portion is caused on the recording member 8. However, the toner 7 on the non-released portion is removed by the second releasing belt 82*b* as described in detail hereinafter.

The front end of the recording member 8 separated by the first separation claw 83*a* inserted into the second pressure contact part. Thus, at the timing that the front end of the recording member 8 reaches the second pressure contact part, the releasing portion 43 of the second releasing belt 82*b* reaches the second pressure contact part. Therefore, as shown in FIG. 25A, the front end of the recording member 8 overlaps with the releasing portion 43 of the second releasing belt 82*b* and enters into the second pressure contact part. AS the circumferential length of the second releasing belt 82*b* is different from that of the first releasing belt 82*a*, the non-released portion of the recording member 8 does not come into contact with the releasing portion 43 of the second releasing belt 82*b* again. Therefore, the toner 7 on the non-released portion is perfectly removed by the releasing member surface layer 23 of the second releasing belt 82*b*. Then, when the front end of the recording member 8 reaches the second separation part, the recording member 8 is separated by the second separation claw 83*b* from the second releasing belt 83*b* as shown in FIG. 25B and discharged in the direction of arrow In the case that the length of the recording member 8 is shorter than the first releasing belt 82*a*, the recording member 8 need not to pass through the second releasing belt 82*b*. Therefore, between the first separation claw 83*a* and the second pressure contact portion is provided a transfer passage changing claw 88 may be provided as shown by two-dots chain line in FIG. 23 to discharge the recording member 8 in the direction of arrow "Y".

The transfer belt 81 may be so arranged that it does not have an independent driving unit. In this case, the transfer belt 81 is halted when the first and second pressure contact rollers 87*a*, 87*b* are in the retreat position, while it follows in accordance with the drive of the first and second releasing belt 82*a*, 82*b* when the first and second pressure contact rollers 87*a*, 87*b* are in the pressure contact position.

On the contrary, it may be arranged that the transfer belt 81 has a driving unit, while the first and second releasing belts 82*a*, 82*b* do not have an independent driving unit. In this case, the first pressure contact roller 87*a* is moved to the pressure contact position at first and the transfer belt 81 is driven, thereby the first releasing belt 82*a* follows the transfer belt 81. At the time when the sensor 41*a* detects the releasing portion 43 of the first releasing belt 82*a*, the first pressure contact roller 87*a* is moved to the retreat position to stand by. Then, the second pressure contact roller 87*b* is moved to the pressure contact position and the transfer belt 81 is driven, thereby the second releasing belt 82*b* follows the transfer belt 81. At the time when the sensor 41*b* detects the releasing portion 43 of the second releasing belt 82*b*, the second pressure contact roller 87*b* is moved to the retreat position to stand by. And then, after the recording member 8 is fed and the front end thereof is detected by the sensor 86, the first and second pressure contact rollers 87*a*, 87*b* are moved to the pressure contact position respectively to commence a printing material removing process.

<Ninth Embodiment>

Figure 26:
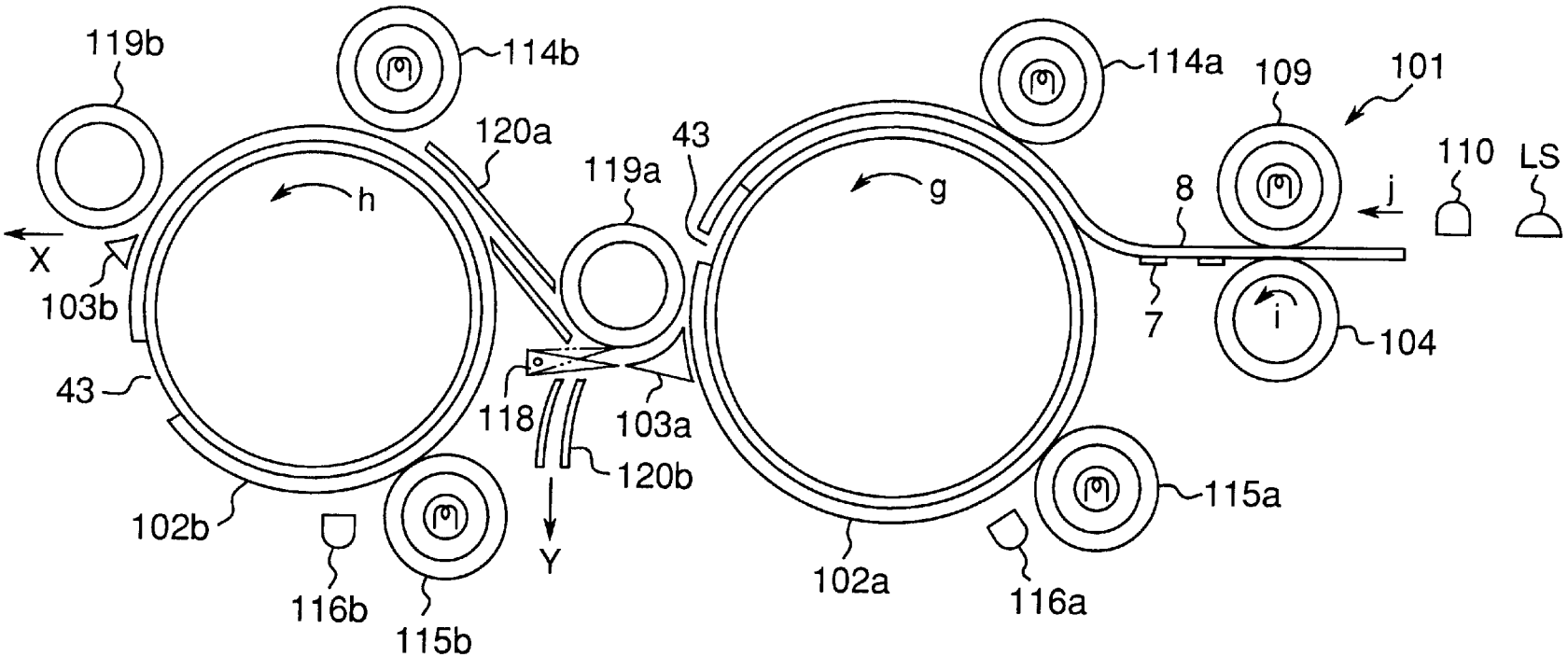
FIG. 26 is a view showing a ninth embodiment of the printing material removing apparatus of the present invention.

FIG. 26 shows a ninth embodiment of the printing material removing apparatus of the present invention.

In this embodiment, there are used first and second cylindrical releasing drums 102*a*, 102*b* which are driven to rotate in the direction of arrows "g", "h" respectively by unshown driving units. The first and second releasing drums 102*a*, 102*b* are disposed apart from each other by a predetermined distance and parallel to each other. The first and second releasing drums 102*a*, 102*b* are made by forming a releasing member surface layer 23 on a base layer 21 of metal through an adhesive layer 22 in the same manner as the first embodiment.

On the right side of the first releasing drum 102*a* is disposed a feed roller 101. The feed roller 101 comprises a driving roller 104 comprises a driving roller 104 for driving in rotation in the direction of arrow "i", and a heating roller 109. The heating roller 109 is disposed above the driving roller 104 and in pressure contact with and opposite to the driving roller 104. The paper feed roller 101 can supply a recording member 8, on which printing material 7 is fixed to form a picture image, in the state of the printing material 7 disposed above, toward the releasing drum 102*a* in the direction of arrow "i". The heating roller 109 corresponding to the heating roller 4*a* of the eighth embodiment of FIG. 23 is to preheat the printing material 7 of the recording member 8 to be supplied.

Upstream side of the transfer direction with respect to the feed roller 101 is disposed a sensor 110 corresponding to the sensor 86 in the eighth embodiment of FIG. 23 for detecting the front end of the recording member 8 to be supplied. Upstream side of the transfer direction with respect to the sensor 110 is disposed a sensor LS for detecting the length of the recording member 8.

On the outer surface of the first releasing drum 102*a* is disposed a heating roller 114*a* for heating the recording member 8 to be transferred on the releasing drum 102*a* (hereinafter, this part is referred to "first pressure contact part"). The heating roller 114*a* corresponding to the heating roller 12 in the eighth embodiment of FIG. 23 is to bring the toner 7 of the recording member 8 with the releasing member surface layer 23 of the releasing drum 102*a* and heat them.

At a position apart from the first pressure contact portion by a predetermined distance to the downstream side of the transfer direction "g", a first separation roller 119*a* and a first separation claw 103*a* (hereinafter, this part is referred to "first separation part"). The separation claw 103*a* corresponding to the separation claw 83*a* in the eighth embodiment of FIG. 23 is to separate the recording member 8 from the releasing member surface layer 23. On the downstream side of the transfer direction with respect to the first separation part is disposed a heating roller 115*a* which comes into pressure contact with the outer surface of the first releasing drum 102*a*. The heating roller 115*a* corresponding to the heating roller 25*a* in the eighth embodiment of FIG. 23 is to heat the toner 7 transferred to the releasing member surface layer 23.

At an appropriate portion opposed to the first releasing drum 102 is disposed a sensor 116*a*. The sensor 116*a* is arranged to detect the front or rear end of the releasing portion 43 in the same manner as the sensor 41*a* in the eighth embodiment of FIG. 23. The position of the sensor 116*a* of the first releasing drum 102*a* is set so that a time that the releasing portion 43 detected by the sensor 116*a* reaches the first pressure contact part coincides with a time that the front end of the recording member 8 detected by the sensor 110 reaches the first pressure contact part.

The second releasing drum 102*b* is formed to have a circumferential length shorter than the first releasing drum 102*a*. On the outer surface of the second releasing drum 102*b*, in the same manner as the eighth embodiment of FIG. 23, a heating roller 114*b*, there are provided a heating roller 114*b* constituting a second pressure contact part, a second separation roller 119*b* and a second separation claw 103*b* constituting a second separation part, a heating roller 115*b*, and a sensor 116*b*.

The position of the sensor 116*b* is set so that a time that the releasing portion 43 detected by the sensor 116*b* reaches the second pressure contact part with a predetermined delayed time added coincides with a time that the front end of the recording member 8 detected by the sensor 110 reaches the second pressure contact part. Namely, it is so constructed that: when the sensor 110 detects the front end of the recording member 8, the first releasing drum is 102*a* is driven; after passing the delayed time, the second releasing drum 102*b* is driven; and whereby the front end of the recording member 8 coincides with the each releasing portion 43 of the first and second releasing drums 102*a*, 102*b*.

Between the first releasing drum 102*a* and the second releasing drum 102*b*, there are provided a re-supply passage 120*a* for guiding the recording member 8 separated from the first releasing drum 102*a* by the first separating roller 119*a* and the first separating claw 103*a* to the second pressure contact part of the second releasing drum 102*b*, a discharge passage 120*b* for guiding the recording member 8, and a transfer passage changing claw 118 for changing the passage between the re-supply passage 120*a* and the discharge passage 120*b*. The transfer passage changing claw 118 is movable to a re-supply position as shown by the solid line and a discharge position as shown by the two-dots chain line by unshown actuator.

In the printing material removing apparatus having above described structure, the operations of the first and second releasing drums 102*a* and 102*b*, the heating rollers 109, 114*a*, 114*b*, 115*a* and 115*b*, the separating rollers 119*a* and 119, and separating claws 103*a*, 103*b* are substantially same as the eighth embodiment, and therefore the description thereof is omitted. Hereinafter, the change of the tansfer passage will be explained.

The length of the recording member 8 to be supplied to the feed roller 101 is detected by the sensor LS. If the length of the first releasing drum 102*a* is longer than the circumferential length of the first releasing drum 102*a*, the middle portion of the recording member 8 overlaps the releasing portion 43 of the first releasing drum 102*a*, causing a non-released portion on the recording member. In this case, the transfer passage changing claw 118 moves to the re-supply position shown by solid line. Thus, after the recording member 8 with the toner removed by the first releasing drum 102*a* is separated from the first releasing drum 102*a* by the first separation roller 119*a* and the first separation claw 103*a*, the recording member 8 is supplied to the second releasing drum 102*b* through the re-supply passage 120*a*, thereby the toner 7 on the non-released portion is removed by the second releasing drum 102*b*. Then, the recording member 8 is separated from the second releasing drum 102*b* by the second separation roller 119*b* and the second separation claw 103*b* and discharged in the direction of arrow "X".

On the other hand, if the length of the recording member 8 is longer than the circumferential length of the first releasing drum 102*a*, the releasing portion 43 of the first releasing drum 102*a* does not overlap the recording member 8 except the front end thereof, thereby non-released portion is not formed on the recording member 8. Therefore, the transfer passage changing claw 118 is moved to the discharge position as shown by two-dots chain line. Thus, after the recording member 8 with the toner removed by the first releasing drum 102*a* is separated from the first releasing drum 102*a* by the first separation roller 119*a* and the first separation claw 103*a*, the recording member 8 is discharged in the direction of arrow "Y" through the discharge passage 120*b*. Thus, the time of toner removing process is shortened and the loss of power consumption is prevented.

Although the present invention has been fully described by way of the examples with reference to the accompanying drawing, it is to be noted that here that various changes and modifications will be apparent to those skilled in the art. Therefore, unless such changes and modifications otherwise depart from the spirit and scope of the present invention, they should be construed as being included therein.

What is claimed is:

1. An apparatus for removing printing material from a recording member on which an image is recorded by the printing material, comprising:

a releasing member which comes in contact with the recording member, and then separates from the recording member to release the printing material from the recording member; and a heater for heating at least one of the recording member and the releasing member, said heater being located upstream from the point of contact between the releasing member and the recording member.

2. The apparatus for removing printing material according to claim 1, wherein the heater heats the recording member in a non-contact condition.

3. The apparatus for removing printing material according to claim 1, wherein the heater heats the recording member in a contact condition.

4. The apparatus for removing printing material according to claim 1, wherein the heater heats the releasing member in a non-contact condition.

5. The apparatus for removing printing material according to claim 1, wherein the heater heats the releasing member in a contact condition.

6. The apparatus for removing printing material according to claim 1, wherein a contact surface of the releasing member, which comes in contact with the recording member, comprises a thermoplastic resin having a softening point of 80 to 180° C. and a SP value of 8 to 12.

7. The apparatus for removing printing material according to claim 1, wherein the recording member is bent with respect to the releasing member to separate the recording member from the releasing member.

8. The apparatus for removing printing material according to claim 1, further comprising a heat insulating wall surrounding a portion of the apparatus for removing printing material in which the recording member is separated from the releasing member.

9. The apparatus for removing printing material according to claim 8, further comprising a heat emitter for emitting the heat inside the heat insulating wall to outside.

10. The apparatus for removing printing material according to claim 8, further comprising a cooling device for cooling the heat inside the heat insulating wall.

11. The apparatus for removing printing material according to claim 1, wherein the releasing member is provided with a releasing portion, and wherein the recording member comes in contact with the releasing member so that the releasing portion coincides with a front end of the recording member.

12. The apparatus for removing printing material according to claim 11, wherein the releasing portion is formed by removing a surface layer of the releasing member.

13. The apparatus for removing printing material according to claim 11, wherein the releasing portion is formed by applying a releasing agent on the surface of the releasing member.

14. The apparatus for removing printing material according to claim 1, further comprising a separating member for separating the recording member from the releasing member, wherein the releasing member is provided with releasing portions in both side ends, and wherein the recording member is separated from the releasing member by bringing the separating member into pressure contact with the releasing portion.

15. The apparatus for removing printing material according to claim 14, wherein the separating member is movable to a pressure contact position where the separating member comes into pressure contact with the releasing member and a retreat position where the separating member retreats from the releasing member.

16. The apparatus for removing printing material according to claim 15, wherein the separating member moves to the pressure contact position when a front end of the recording member approaches the separating member, and moves to the retreat position when the front end of the recording member is separated from the releasing member.

17. The apparatus for removing printing material according to claim 16, wherein the releasing member comes in contact with the recording member so that the releasing portion overlaps with the front end of the recording member.

18. The apparatus for removing printing material according to claim 1, wherein the releasing member includes a first rotatable member and a second rotatable member having a different circumferential length from the first rotatable member, and wherein a part of each rotatable member is provided with a releasing portion, whereby a front end of the first rotatable member of the releasing member comes in contact with the recording member so that a front end of the recording member overlaps with the releasing portion of the first rotatable member, and then a front end of the second rotatable member of the releasing member comes in contact with the recording member so that the front end of the recording member overlaps with the releasing portion of the second rotatable member.

19. The apparatus for removing printing material according to claim 18, further comprising a length detector for detecting the length of the recording member and a transfer passage changer, by which if the length of the recording member detected by the length detector is shorter than the circumferential length of the first rotatable member, the recording member does not pass through the second rotatable member.

20. The apparatus for removing printing material according to claim 19, further comprising a separation claw for separating the recorded member from the releasing member.

21. The apparatus for removing printing material according to claim 1, further comprising another heater for heating said releasing member at the point of contact between the releasing member and the recording member.

22. An apparatus for removing printing material from a recording member on which an image is recorded by the printing material, comprising:

a releasing member which comes in contact with the recording member and then separates from the recording member to release the printing material from the recording member; and a heater for heating at least one of the recording member and the releasing member without contacting them.

23. The apparatus according to claim 22, wherein the heater is a far infrared heater.

24. The apparatus according to claim 22, wherein the heater is located so as to face at least one of a surface of the recording member on which the image is recorded by the printing material and a surface of the releasing member which comes in contact with the recording member.

25. An apparatus for removing printing material from a recording member on which an image is recorded by the printing material, comprising:

a releasing member which comes in contact with the recording member by a contact surface thereof and then separates from the recording member to release the printing material; and a heater for directly heating the contact surface of the releasing member, said heater being located at a position other than the point of contact between the releasing member and the recording member so as to face the contact surface of the releasing member.

26. The apparatus according to claim 25, wherein the heater heats the contact surface of the releasing member without contacting it.

27. The apparatus according to claim 26, wherein the heater is a far infrared heater.

* * * * *